73-151
7/20/76 OR 3,969,937 SR

United States Patent [19]
Barrington et al.

[11] 3,969,937
[45] July 20, 1976

[54] METHOD AND APPARATUS FOR TESTING WELLS

[75] Inventors: Burchus Q. Barrington; David L. Farley; O. L. Morrisett, all of Duncan, Okla.

[73] Assignee: Halliburton Company, Duncan, Okla.

[22] Filed: Sept. 12, 1975

[21] Appl. No.: 612,841

Related U.S. Application Data

[63] Continuation-in-part of Ser. No. 517,488, Oct. 24, 1974.

[52] U.S. Cl. ..... 73/151; 166/264
[51] Int. Cl.[2] ..... E21B 47/00
[58] Field of Search ..... 73/155, 421 R, 151; 166/264, 100

[56] References Cited

UNITED STATES PATENTS 3,358,755 12/1967 Chisholm ..... 166/264
3,412,607 11/1968 Jensen ..... 166/264 X

*Primary Examiner*—Jerry W. Myracle
*Attorney, Agent, or Firm*—John H. Tregoning; Bruce E. Burdick

[57] ABSTRACT

Method and apparatus for testing wells where extremely high temperatures and pressures are to be encountered in the zone under test. The apparatus provides means for testing and trapping samples of well fluid from the formation in the zone under test for removal from the well bore with substantial reduction in sample pressure at the ground surface. The method permits confining the well fluid under test within the well bore near the zone under test to minimize the possibility of hazardous well fluids reaching the ground surface other than as trapped samples in expandable sampler chambers or otherwise safely controlled.

26 Claims, 24 Drawing Figures

METHOD AND APPARATUS FOR TESTING WELLS

CROSS-REFERENCE TO RELATED APPLICATION

This is a continuation-in-part of U.S. patent application Ser. No. 517,488, filed Oct. 24, 1974.

BACKGROUND OF THE INVENTION

1. Field of the Invention

The present invention relates to oil and gas well testing and, more particularly, but not by way of limitation, to method and apparatus for safely testing and sampling potentially hazardous well fluids in hostile environments.

2. Description of the Prior Art

In the past, formation testing has been employed to determine the potential productivity of subsurface formations in either open or cased well bores. The prior art testing procedures requires the opening of a section of the well bore to atmospheric or reduced pressure. The prior art method has previously been accomplished by lowering a test string into the well bore on drill pipe with the tester valve closed to prevent entry of well fluid into the drill pipe. With the packer of the testing string expanded to provide a seal above the zone to be tested, the tester valve is opened. The packer is then relied upon to support the hydrostatic pressure load of the well fluid. The formation below the packer is relieved of this pressure and is exposed through the open tester valve to the atmospheric pressure in the empty drill pipe so that its ability to produce fluid can be determined.

After a specified time interval, the formation is closed in to measure its rate of pressure build-up.

At the end of the test the tester valve is closed and pressure is equalized across the packer to permit it to be unseated. Formation fluid recovered during the test can be removed from the drill pipe by reverse circulation before the pipe is removed from the hole. Formation pressures are generally recorded throughout the test by a subsurface pressure recording device included in the testing string.

Such prior art formation testing techniques are not appropriate for extremely deep wells where formation pressures of approximately 20,000 p.s.i. and temperatures of approximately 500° F. may be encountered. Safety considerations prevent the venting of such formation pressures to the atmosphere as is common practice in the prior art. This limitation of the prior art method and apparatus is particularly apparent when $H_2S$ or $CO_2$ is a substantial component of the well fluids encountered in the zone under test.

SUMMARY OF THE INVENTION

The present invention contemplates apparatus for testing a formation in a zone penetrated by a well bore which includes conduit means positionable in the well bore for conveying fluids therethrough within the well bore. The conduit means includes sampler chamber means in selective communication with the interior of the conduit means. The valve means is carried by the conduit means and is responsive to manipulation of the conduit means for selectively opening conduit means to fluid flow bypassing the sampler chamber means, and, alternately, directing fluid flow from the interior of the conduit means through the sampler chamber means and back into the interior of the conduit means, and again opening the conduit means to fluid flow bypassing the sampler chamber means while simultaneously trapping a fluid sample in the sampler chamber means. The conduit means also carries well bore isolation means responsive to manipulation of the conduit means for selectively isolating the zone under test from the annulus between the exterior of the conduit means and the wall of the well bore. The conduit means includes port means carried therein below the well bore isolation means for providing fluid communication between the isolated zone under test and the interior of the conduit means. The conduit means further carries valve means above the sampler chamber means for selectively opening and closing the conduit means to fluid flow therethrough.

It is an object of the present invention to provide a drill test string suitable for testing zones in extremely deep well bores.

Another object of the invention is to provide a method of safely testing and sampling formation fluids from the zone under test in extremely deep well bores.

A further object of the invention is to provide an improved sampler chamber assembly for trapping high pressure well fluid samples and providing means for safely conveying the samples to the ground surface for testing and evaluation.

Other objects and advantages of the invention will be evident from the following detailed description when read in conjunction with the accompanying drawings.

DESCRIPTION OF THE PREFERRED EMBODIMENT

Figure 1:
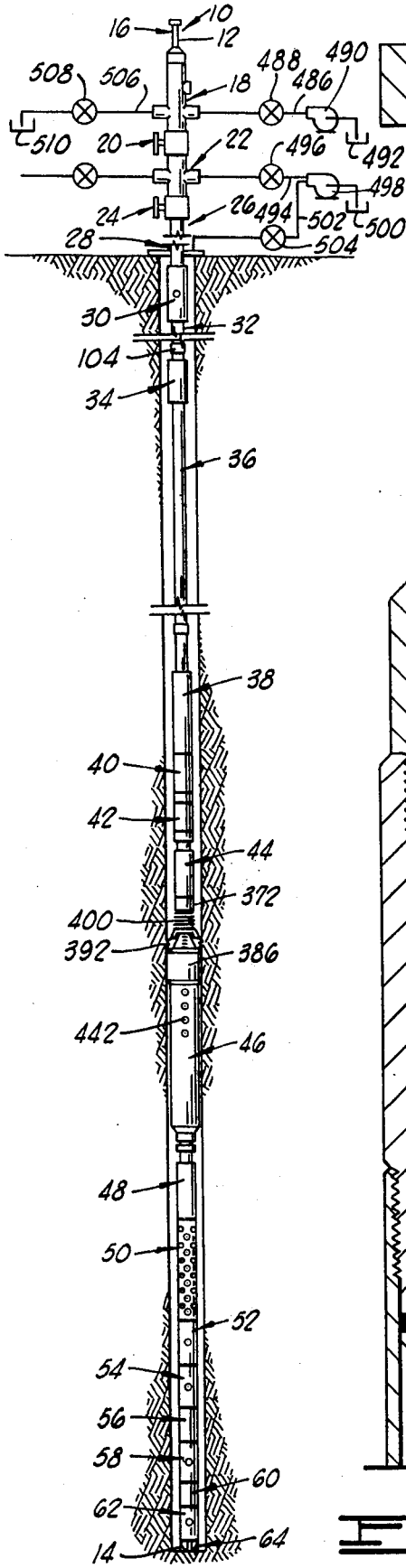
FIG. 1 is an elevational view illustrating the drill test string of the present invention positioned in a well bore.
Figure 2:
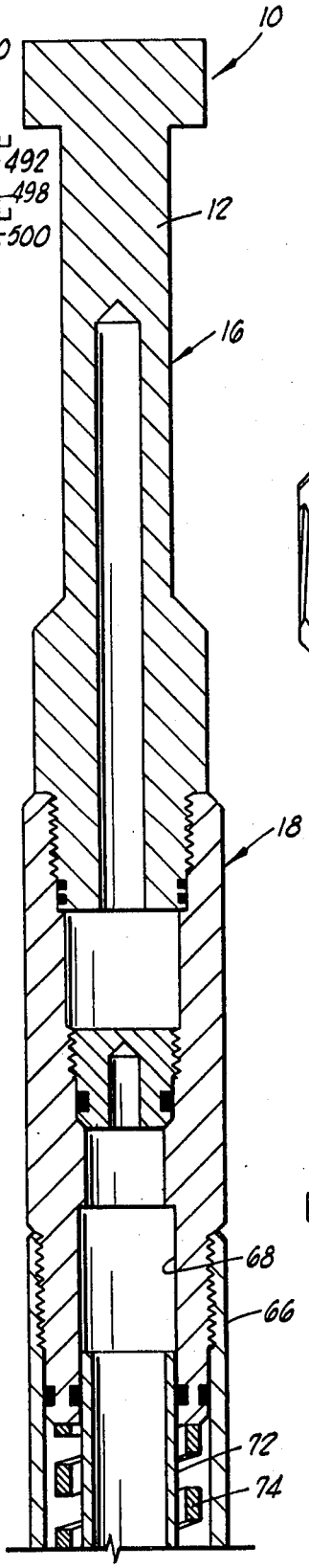
FIG. 2 is an enlarged vertical cross-sectional view of the upper end portion of the drill test string of FIG. 1 illustrating the lifting sub and the upper portion of the sleeve type safety valve assembly.
Figure 3:
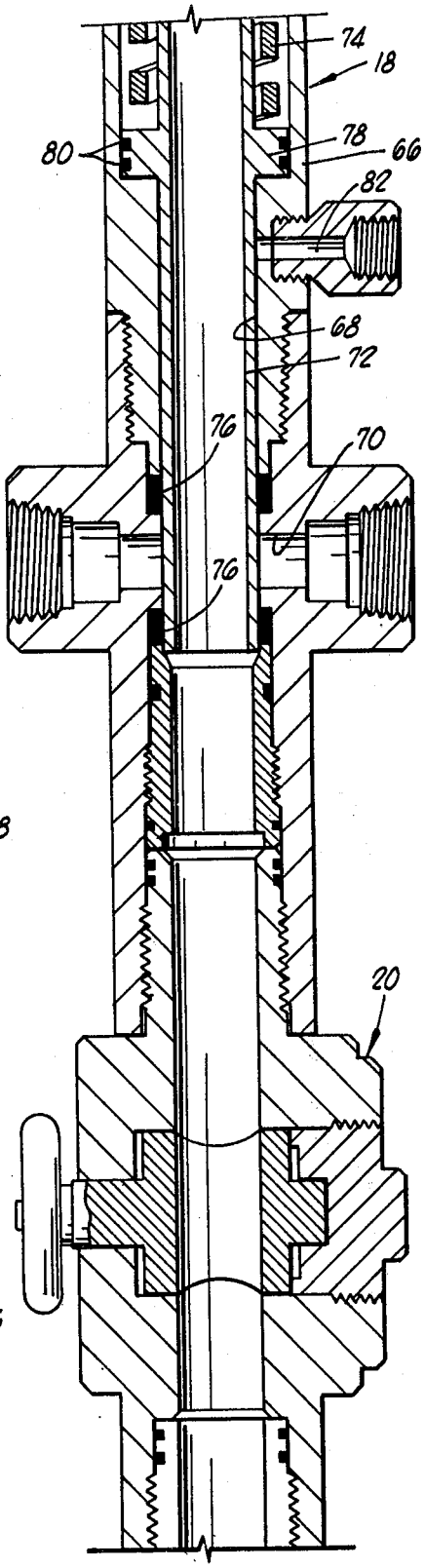
FIG. 3 is an enlarged cross-sectional view of a portion of the drill test string of FIG. 1 illustrating the lower portion of the sleeve type safety valve assembly and the upper master valve assembly.
Figure 4:
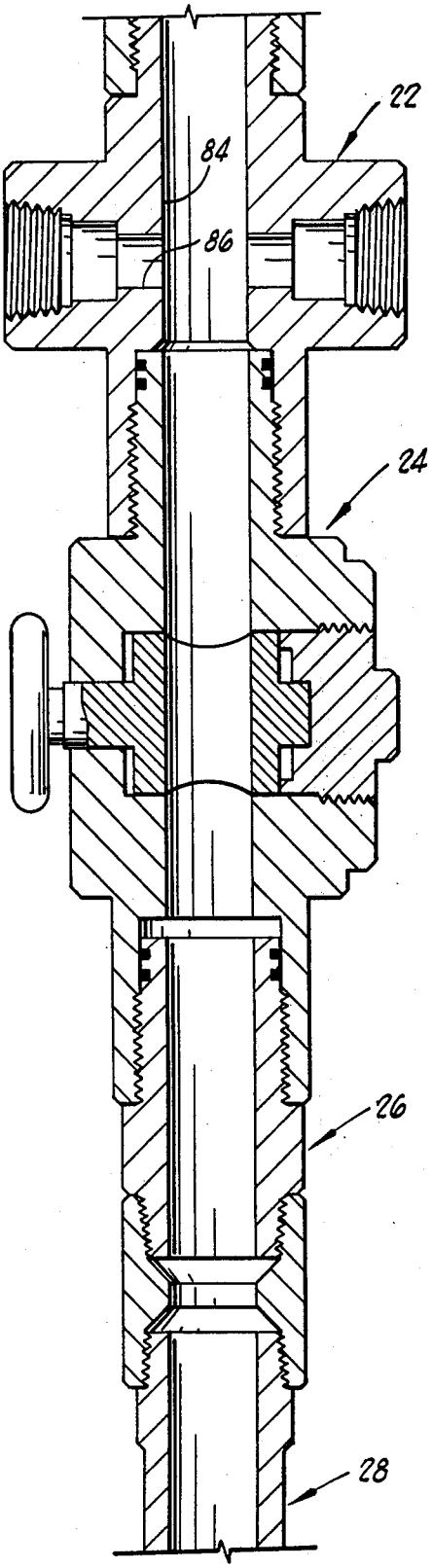
FIG. 4 is an enlarged vertical cross-sectional view of a portion of the drill test string of FIG. 1 illustrating the flow cross kill line connection assembly, the lower master valve assembly, the tubular threaded adapter and the upper end portion of the first length of drill pipe.
Figure 5:
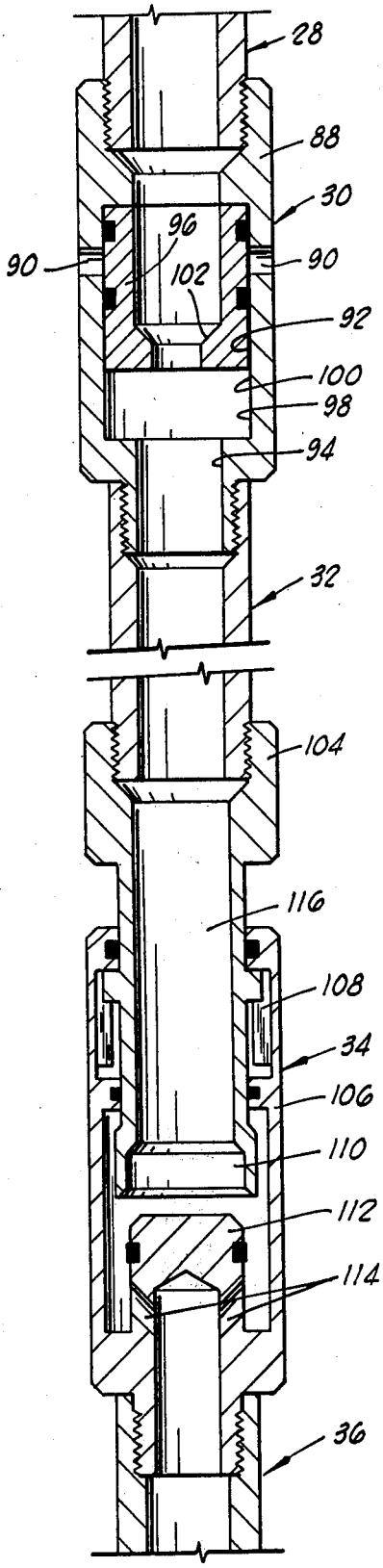
FIG. 5 is an enlarged vertical cross-sectional view of a portion of the drill test string of FIG. 1 illustrating the lower end portion of the first length of drill pipe, the sleeve impact reversing sub, the second length of drill pipe, the uphole safety valve assembly and the upper end portion of the third length of drill pipe.

Referring now to the drawings, the drill test string of the present invention is generally designated by the reference character 10 and is shown in FIG. 1. The test string 10 comprises the following elements moving from the upper end portion 12 to the lower end portion 14 in consecutive order: a lifting sub 16; a remotely controlled fluid actuated, sleeve-type safety valve assembly 18; an upper master valve assembly 20; a flow cross kill line connection assembly 22; a lower master valve assembly 24; a tubular threaded adapter 26; a first length of drill pipe 28; a sleeve impact reversing sub 30; a second length of drill pipe 32; an uphole, gravity-actuated safety valve assembly 34; a third length of drill pipe 36; a gravity-actuated flow direction valve and expandable sampler chamber assembly 38; a flow stream recorder assembly 40; a hydraulic jar assembly 42; an upper safety joint assembly 44; a packer assembly 46; a lower or anchor pipe safety joint assembly 48; a perforated anchor pipe 50; a check valve assembly 52; a maximum temperature thermometer assembly 54; a temperature recorder assembly 56; an upper blanked-off pressure recorder assembly 58; a tubular spacer element 60; a lower blanked-off pressure recorder assembly 62; and an anchor shoe 64.

The sleeve type safety valve assembly 18 includes a housing assembly 66 having a longitudinal passageway 68 extending therethrough. A transverse passageway 70 intersects the longitudinal passageway 68 and may be connected in communication with one or two separate conduits through which fluid may be introduced into or removed from the drill test string 10. A cylindrical valve member 72 is slidably received within the housing assembly 66 and is biased into a normally closed position blocking communication between the passageways 68 and 70 by means of a compression coil spring 74. Annular seals 76 provide a fluid-tight seal between the valve member 72 and the housing assembly 66 when the valve is closed. An annular piston 78 is formed on the valve member 72 and carries annular seals 80 thereon to provide a sliding fluid-tight seal between the piston 78 and the inner periphery of the housing assembly 66. The valve is opened against the bias of the spring 74 by the application of a sufficient fluid pressure through port 82 formed in the housing assembly 66 which pressure acts on the differential area defined by the inner periphery of the housing assembly 66 engaged by the annular seals 80 and the diameter of the lower portion of the valve member 72 engaged by the annular seals 76 to overcome the bias of the spring 74.

The upper and lower master valve assemblies 20 and 24 are of conventional design and may be operated individually to open and close the drill test string 10 to fluid flow therethrough as may be desired. The flow cross kill line connection assembly 22 includes a longitudinal passageway 84 therethrough and a transverse passageway 86 formed therein intersecting the passageway 84. The passageway 86 may be connected with one or two separate conduits to which fluid may be introduced into or removed from the test string 10.

The tubular threaded adapter 26 provides threaded interconnection between the lower master valve assembly 24 and the upper end of the first length of drill pipe 28.

The sleeve impact reversing sub 30 includes a housing 88 threadedly secured to the lower end of the drill pipe 28. A plurality of ports 90 are formed in the housing 88 and communicate between a cylindrically shaped portion 92 of the longitudinal passageway 94 extending through the housing 88. A sleeve valve member 96 is releasably secured within the cylindrically shaped portion 98 of the longitudinal passageway 100. A suitable reversing sub for this application is manufactured and sold by Halliburton Services and is described on page 2544 of the Halliburton Services Sales and Service Catalog, Number 37.

The sleeve valve member 96 may be suitably secured within the cylindrically shaped portion 98 of the longitudinal passageway 100 by means of shear pins (not shown) or the like. When desired, the sleeve valve member 96 may be released by dropping a bar down the drill test string 10 which will impact on the annular shoulder 102 of the sleeve valve member 98 thereby forcing it downwardly within the longitudinal passageway 100 and providing communication between the longitudinal passageway 100 and the exterior of the housing 88 via the ports 90 to permit reverse circulation therethrough.

The upper end portion of the second length of drill pipe 32 is threadedly secured to the lower end portion of the housing 88 of the sleeve impact reversing sub 30. The lower end portion of the drill pipe 32 is threadedly secured to the upper end portion of a mandrel 104 forming a portion of the uphole safety valve assembly 34.

In addition to the mandrel 104, the uphole safety valve assembly 34 further includes a housing 106 in which the mandrel 104 is slidably received. The mandrel 104 is prevented from rotating relative to the housing 106 by means of longitudinal splined engagement therebetween as shown at 108. It will be seen that when the mandrel 104 is telescoped downwardly relative to the housing 106 fluid passage through the uphole safety valve assembly 34 is precluded through the sealing engagement of the lower end portion 110 of the mandrel 104 with an upwardly extending cylindrically shaped member 112 formed in the lower portion of the housing 106. When the mandrel 104 is fully extended relative to the housing 106 it will be seen that fluid may pass through the uphole safety valve assembly 34 via ports 114 formed in the member 112 and through the cylindrically shaped passageway 116 extending through the mandrel 104.

The upper end portion of the third length of drill pipe 36 is threadedly secured to the lower end portion of the housing 106 of the uphole safety valve assembly 34. The lower end portion of the drill pipe 36 is threadedly secured to the upper end portion of the flow direction valve and expandable sampler chamber assembly 38.

The expandable sampler chamber assembly 38 comprises a housing assembly 118 and a mandrel assembly 120. The housing assembly 118 includes an upper housing 122, an intermediate housing 124 and a lower housing 126. The housings 122, 124 and 126 are substantially cylindrically shaped. The lower end portion 128 of the upper housing 122 slidingly and sealingly receives the upper end portion 130 of the intermediate housing 124 therein. Similarly, the lower end portion 132 of the intermediate housing slidingly and sealingly receives the upper end portion 134 of the lower housing 126 therein.

The mandrel assembly 120 comprises an operating mandrel 136, an upper sampler mandrel 138 and a lower sampler mandrel 140. The upper end portion 142 of the operating mandrel 136 is suitably threadedly secured to the lower end portion of the drill pipe 36 by means of a suitably threaded collar 144. Below its connection with the drill pipe 36 the operating mandrel is slidably received within the upper housing 122. The upper sampler mandrel 138 is slidably received within the housing assembly 118 with the upper end portion 146 disposed within the upper housing 122 and with the lower end portion 148 disposed within the intermediate housing 124. The upper end portion 146 of the upper sampler mandrel 138 is releasably securable to the lower end portion 150 of the operating mandrel 136 and, alternately, releasably securable to the inner portion of the upper housing 122 as will be described in detail hereinafter. The lower end portion 148 of the upper sampler mandrel 138 is releasably securable to the upper end portion 152 of the lower sampler mandrel 140 by suitable means.

The mandrel assembly 120 provides a tubular passageway 154 therethrough providing communication between the drill pipe 36 and the lower end portion 156 of the lower sampler mandrel 140. The tubular passageway 154 comprises passageway 158 formed in the operating mandrel 136, passageway 160 formed in the upper sampler mandrel 138, and the passageway 162 formed in the lower sampler mandrel 140.

A J-slot lug collar 164 is positioned about the upper end portion 142 of the operating mandrel 136. The lug collar 164 includes a pair of radially outwardly extending lugs 166 formed thereon and positioned diammetrically opposite one another. The lugs 166 are respectively received in a pair of identical J-slots 168 formed in the upper housing 122 and also positioned diammetrically opposite one another. A compression coil spring 170 is disposed around the operating mandrel 136 with the upper end 172 abutting the collar 164 and with the lower end 174 abutting a radially inwardly extending annular shoulder 176 formed in the upper housing 122. The compression coil spring 170 provides a predetermined upward bias on the operating mandrel 136 relative to the upper housing 122. An annular seal 178 provides a fluid-tight seal between the interior wall of the upper housing 122 and the outer cylindrical surface of the operating mandrel 136. The annular space between the operating mandrel 136 and the upper housing 122 above the annular seal 178 is vented to the exterior of the upper housing 122 via a pressure equalization port 180.

A cylindrically shaped annular space 182 is formed within the upper housing 122 between the cylindrical inner wall 184 of the upper housing and the cylindrical outer periphery 186 of the operating mandrel 136. An annular pressure equalizing piston 188 is positioned within the annular space 182 and provides sliding sealing engagement between the inner wall 184 of the upper housing and the outer periphery 186 of the operating mandrel. The annular space between the pressure equalizing piston 188 and the annular seal 178 is vented to the exterior of the upper housing via a pressure equalizing port 190.

A radially inwardly extending annular shoulder 192 is formed within the upper housing 122 and extends from the inner wall 184. The annular shoulder 192 includes a plurality of longitudinally extending grooves 194 formed therein. A plurality of longitudinally extending splines 196 are formed on the outer periphery 186 of the operating mandrel 136 and are longitudinally slidingly received within the groove 194 to prevent relative rotation between the operating mandrel and the upper housing. The lower end of the annular shoulder 192 communicates with a cylindrical inner wall 198 formed within the upper housing 122.

An outwardly extending annular shoulder 200 is formed on the operating mandrel 136 and includes an annular seal 202 carried therein to provide a sliding fluid-tight seal between the annular shoulder 200 and the cylindrical inner wall 198. It will be seen that the annular shoulder 200 provides a positive limitation to the upward movement of the operating mandrel 136 within the upper housing 122. An annular seal 204 is carried within the upper housing 122 and provides a sliding fluid-tight seal between the cylindrical inner wall 206 of the upper housing and the cylindrical outer periphery 208 of the operating mandrel 136 which extends downwardly from the annular shoulder 200.

The annular space between the upper housing 122 and the operating mandrel 136 intermediate the pressure equalizing piston 188 and the annular seal 204 defines a hydraulic impedance oil reservoir 210. A plurality of passageways 212 of extended length and restricted cross-sectional area communicate between hydraulic impedance inlet ports 124 positioned below the annular shoulder 200 and annular seal 202 and hydraulic impedance outlet ports 216 formed in the operating mandrel 136 above the annular shoulder 200 and annular seal 202. Hydraulic impedance dump ports 218 communicate between the cylindrical inner wall 198 of the upper housing 122 and an annular passageway 220 which provides means for fast downward movement of the operating mandrel 136 relative to the upper housing 122 for a limited distance when the annular seal 202 moves below the dump ports 218 during the operation of the apparatus. It will be understood when the apparatus is assembled, the hydraulic impedance oil reservoir 210 and the passageways 212 are filled with oil.

It should be understood that the hydraulic impedance structure described above operates when weight is placed on the operating mandrel 136 to move it downwardly relative to the upper housing 122 against the upward bias of the coil spring 170. As the operating mandrel 136 moves downwardly, the oil trapped in the reservoir 210 below the annular seal 202 is forced through the ports 214 and the restrictive passageways 212 outwardly through the outlet ports 216 into the reservoir above the seal 202. The cross-sectional area of the passageways 212 will have been preselected to provide a suitable impedance to the downward movement of the operating mandrel relative to the upper housing. It will also be seen that when the annular seal 202 moves below the dump ports 218, the oil in the reservoir below the seal 202 is free to flow rapidly through the annular passageway 220 and the dump ports 218 into the annular space above the seal 202 thus allowing much faster downward movement of the operating mandrel 136 relative to the upper housing 122 for a limited distance. This sudden increase in downward movement of the operating mandrel provides indication at the ground surface that the operating mandrel has moved to its lowermost position and that the sampler chambers are open as will be described more fully hereinafter.

Figure 14:
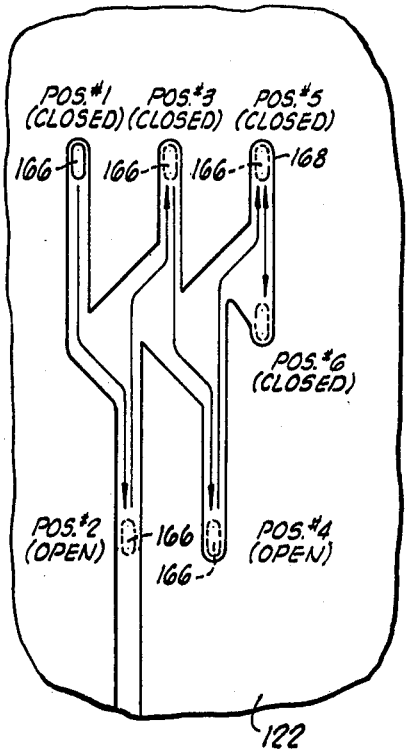
FIG. 14 is a schematic illustration of lug and slot components of one of the J-slots of the flow direction and expandable sampler chamber assembly.

FIG. 14 illustrates diagrammatically the lay-out of one J-slot 168 illustrating the various positions of the respective lug 166 therein. It will be seen that when the lug 166 is in position No. 1 as is illustrated in FIG. 14, the sampler chambers of the flow direction valve and expandable sampler chamber assembly 38 are closed as will be described in more detail hereinafter. When weight is set on the operating mandrel 136, sufficient to overcome the bias of the spring 170 and the retardation applied by the hydraulic impedance mechanism, the lug 166 is moved to position No. 2 which opens the sampler chambers. When weight is removed from the operating mandrel 136 sufficient to allow full extension of the compression spring 170, the lug 166 moves to position No. 3 in the J-slot 168 which again places the sampler chambers in closed position. A second downward movement of the operating mandrel 136, as described immediately above, will position the lug 166 in position No. 4 thus placing the sampler chambers in the open position for a second and last time. When weight is removed from the operating mandrel 136, sufficient for the compression spring 170 to fully extend a second time, the lug 166 assumes position No. 5 thereby closing the sampler chamber a second and last time. Any additional vertical manipulation of the operating mandrel 136 relative to the upper housing 122 will only cause the lug 166 to move between positions No. 5 and No. 6, both of which retain the sampler chambers in the closed position.

The lower end portion 150 of the operating mandrel 136 is removably securable to the upper end portion 146 of the upper sampler mandrel 138 by means of a plurality of upwardly extending spring locking fingers 222 formed on the upper end portion of the upper sample mandrel.

Figure 6A:
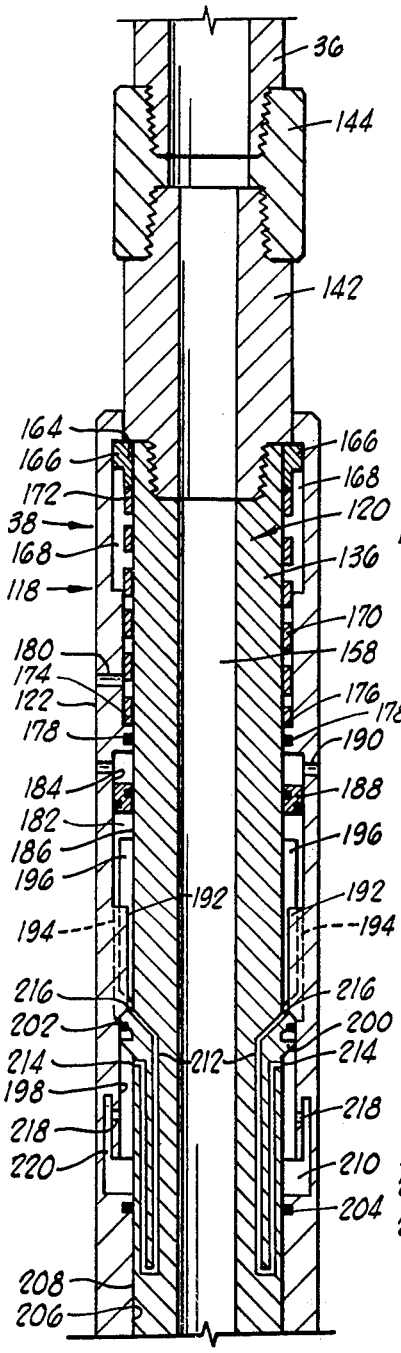
FIG. 6A is an enlarged vertical cross-sectional view of a portion of the drill test string of FIG. 1 illustrating the lower end portion of the third length of pipe and the upper portion of the flow direction valve and expandable sampler assembly when the expandable sampler chambers are closed and the flow direction valve and expandable sampler assembly is open to fluid flow therethrough around the closed sampler chambers.
Figure 6B:
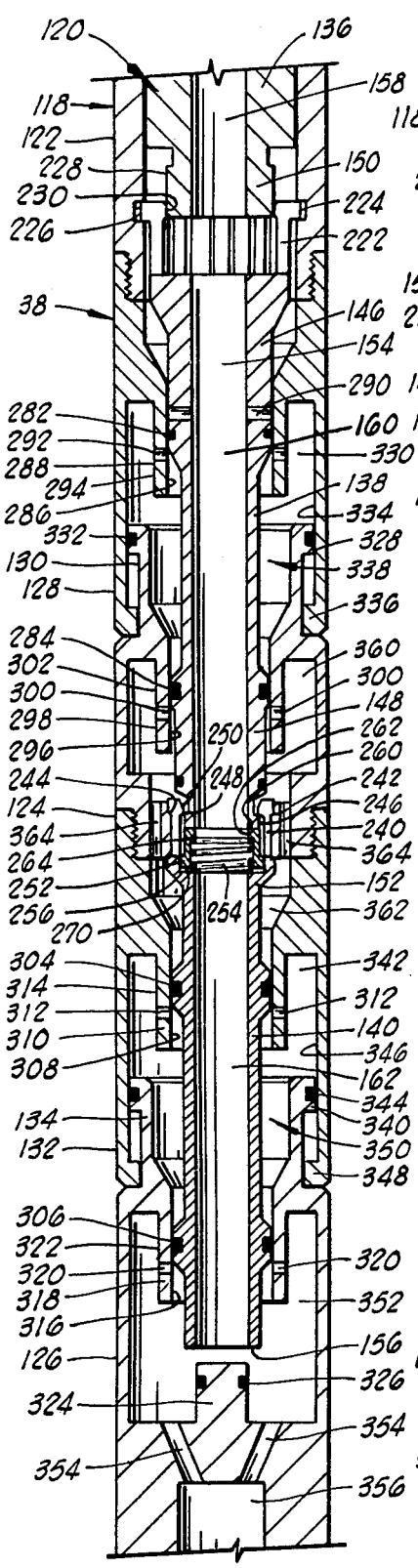
FIG. 6B is an enlarged vertical cross-sectional view of a portion of the drill test string of FIG. 1 illustrating the lower portion of the flow direction valve and expandable sampler assembly when the expandable sampler chambers are closed and the housing assembly is telescopically collapsed.

As shown in FIGS. 6A and 6B, when the operating mandrel 136 is in its upper position with the lugs 166 in position Nos. 1, 3 or 5 in the U-slot 168, radially outwardly extending shoulders 224 formed on the spring locking fingers 222 are securely engaged in an annular groove 226 formed within the upper housing 122 thereby preventing longitudinal movement of the upper sampler mandrel 138 relative to the upper housing 122. The annular shoulders 224 of the spring fingers 222 are securely retained in engagement with the annular grooves 226 by means of cylindrical surface 228 formed on the lower end portion 150 of the operating mandrel which slidingly engages the radially inwardly extending shoulders 200 formed on the upper ends of the spring fingers 222.

When the operating mandrel 136 is moved downwardly relative to the upper housing 122 to assume either position No. 2 or position No. 4, the lower end face 232 of the operating mandrel engages the upper end face 234 of the upper sampler mandrel 138. This positions an annular groove 236 formed in the cylindrical surface 228 of the operating mandrel in registration with the inwardly extending shoulders 230 of the spring fingers 222 thus releasing the locking force exerted on the spring fingers 222 which previously retained the radially outwardly extending shoulders 224 in engagement with the annular shoulder 226 of the upper housing 122. With the locking fingers 222 thus released from engagement with the upper housing 122, the further downward movement of the operating mandrel 136 relative to the upper housing 122 causes the release of the upper sampler mandrel 138 from the upper housing and the simultaneous engagement of the upper sampler mandrel 138 with the operating mandrel 136 through the engagement of the shoulders 230 of the locking fingers 222 with the annular groove 236. The engagement of the inwardly extending shoulders 230 with the annular groove 236 is maintained through the sliding engagement of cylindrical inner surface 238 of the upper housing with the radially outwardly extending shoulders 224 of the spring locking fingers 222.

Figure 7A:
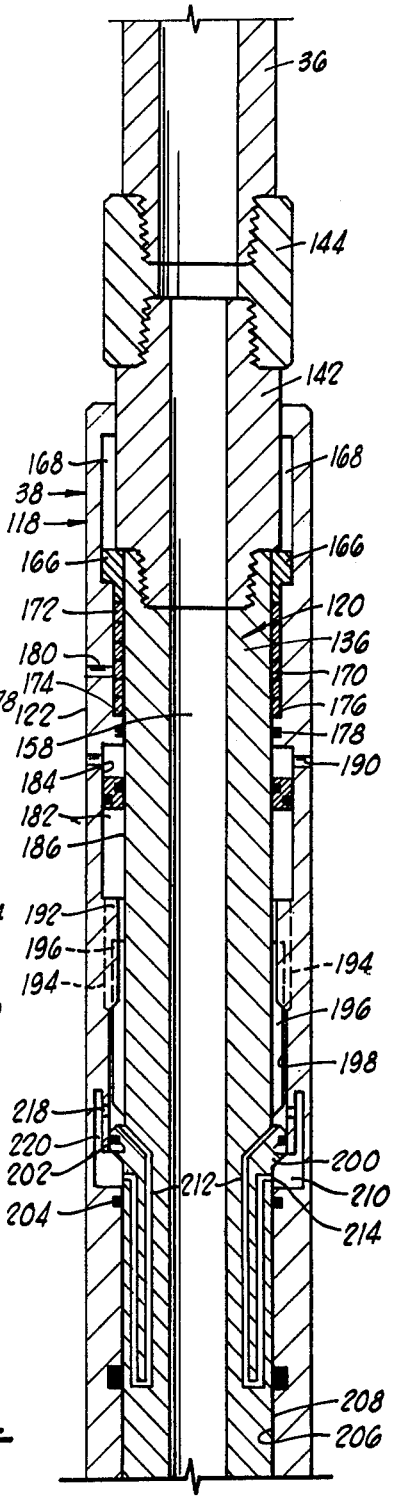
FIG. 7A is an enlarged vertical cross-sectional view of a portion of the drill test string of FIG. 1, similar to FIG. 6A, and illustrating the lower end portion of the third length of pipe and the upper portion of the flow direction valve and expandable sampler assembly when the expandable sampler chambers are open and the flow direction valve and expandable sampler assembly is open to fluid flow therethrough through the open sampler chambers.
Figure 7B:
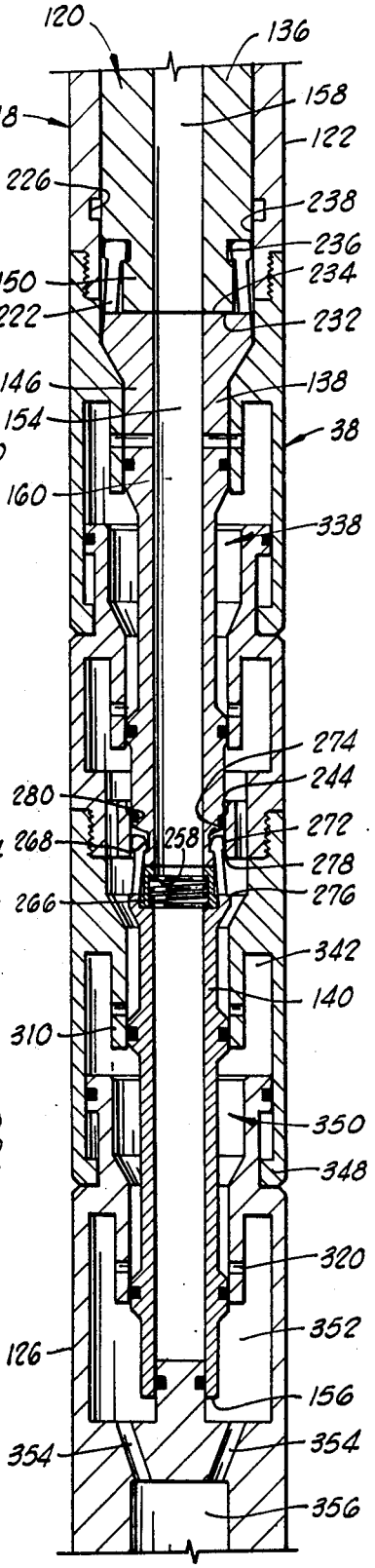
FIG. 7B is an enlarged vertical cross-sectional view of a portion of the drill test string of FIG. 1, similar to FIG. 6B, and illustrating the lower portion of the flow direction valve and expandable sampler assembly when the expandable sampler chambers are open and the housing assembly is telescopically collapsed.
Figure 8:
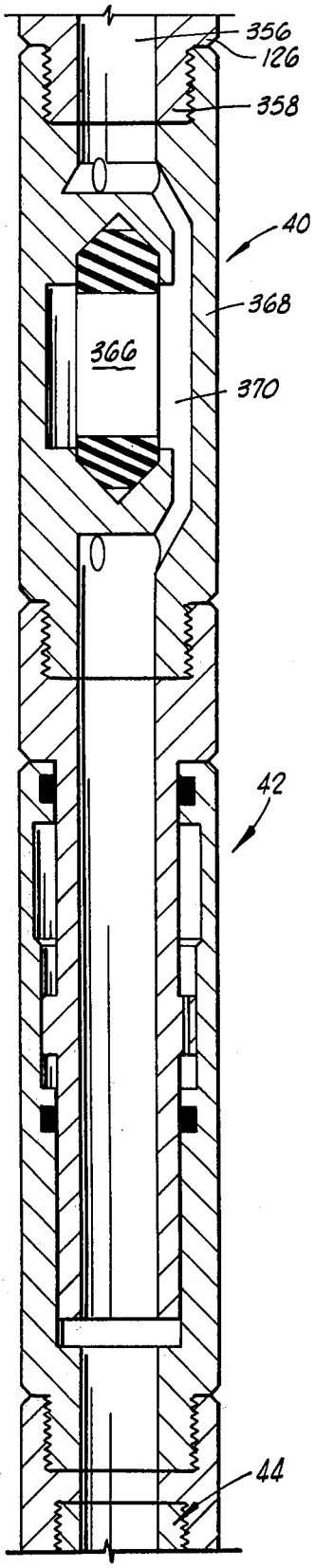
FIG. 8 an enlarged vertical cross-sectional view of a portion of the drill test string of FIG. 1 illustrating the lower end portion of the flow direction valve and expandable sampler assembly, the flow stream recorder assembly, the hydraulic jar assembly and the upper end portion of the upper safety joint assembly 44.
Figure 12:
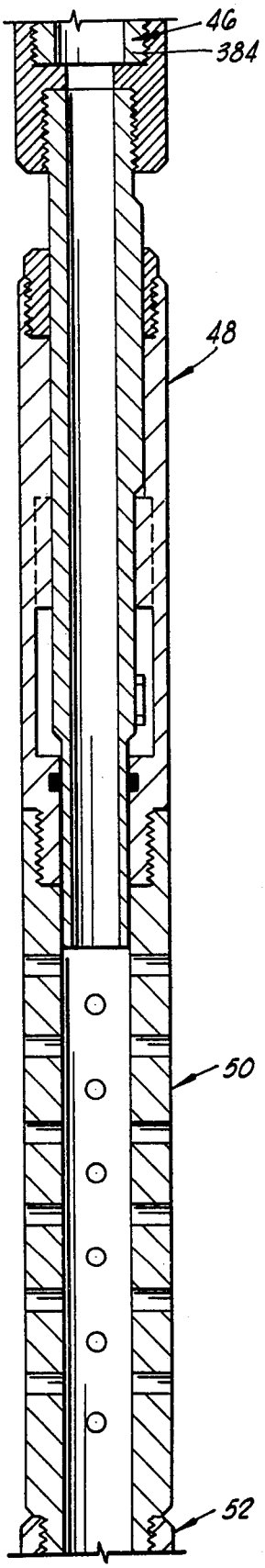
FIG. 12 is an enlarged vertical cross-sectional view of a portion of the drill test string of FIG. 1, illustrating the lower end portion of the packer assembly, the anchor pipe safety joint assembly, the perforated anchor pipe and the upper end portion of the check valve assembly.
Figure 13:
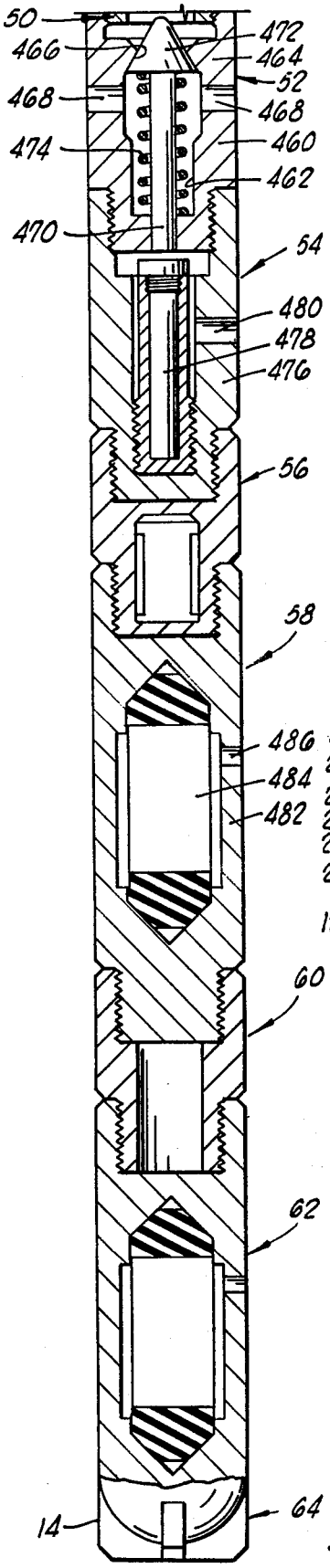
FIG. 13 is an enlarged vertical cross-sectional view of the lower end portion of the drill test string of FIG. 1 illustrating the lower end portion of the perforated anchor pipe, the check valve assembly, the maximum temperature thermometer assembly, the temperature recorder assembly, the upper blanked-off pressure recorder, the tubular spacer element, the lower blanked-off pressure recorder assembly and the anchor shoe.

As shown in FIGS. 6B and 7B, the lower end portion 148 of the upper sampler mandrel 138 is releasably secured to the upper end portion 152 of the lower sampler mandrel 140 by means of a plurality of upwardly extending spring locking fingers 240 formed on the upper end portion 152 of the lower sampler mandrel. In FIG. 6B, it will be seen that outwardly extending shoulders 242 formed respectively on the spring locking fingers 240 engage a radially inwardly extending annular shoulder 244 formed on the inner periphery of the intermediate housing 124 thus preventing the downward movement of the lower sampler mandrel 140 relative to the intermediate housing 124. The spring locking fingers 240 are retained in engagement with the annular shoulder 244 of the intermediate housing 124 through the engagement of cylindrical outer surface 246 of the upper sampler mandrel 138 with the cylindrically shaped surfaces 248 formed on the radially inwardly extending shoulder 250 of each spring locking finger 240.

A substantially cylindrically shaped piston 252 is slidably disposed within the spring fingers 240. A compression coil spring 254 extends between an upwardly facing annular shoulder 256 formed in the upper end portion 152 of the lower sampler mandrel 140 and a downwardly facing annular shoulder 258 formed within the piston 252. The coil spring 254 biases the piston 252 upwardly to engage the upper end face 260 of the piston with the lowe end face 262 of the upper sampler mandrel 138. See FIG. 6C. The piston 252 includes a cylindrical outer surface 264 having a diameter substantially equal to the diameter of the cylindrical outer surface 246 of the upper sampler mandrel. A radially outwardly extending shoulder 266 is formed on the lower end of the piston 252 and extends outwardly from the surface 264.

It will be seen in FIG. 7B that when the lower end portion 148 of the upper sampler mandrel 138 is moved downwardly relative to the intermediate housing 124 an annular groove 268, formed in the lower end portion of the upper sampler mandrel, is positioned in registration with the inwardly extending shoulders 250 of the spring locking fingers 240. It will also be seen that the lower end face 262 of the upper sampler mandrel abuts the upper end face 260 of the piston 252, and the lower end face 270 of the piston 252 abuts the annular shoulder 256 of the lower sampler mandrel 140. As the upper sampler mandrel 138 forces the piston 252 and the lower sampler mandrel 140 downwardly relative to the intermediate housing 124, the outwardly extending shoulders 242 of the spring locking fingers 240 become disengaged with the annular shoulder 244 of the intermediate housing and the spring locking fingers are deflected inwardly such that the inwardly extending shoulders 250 extend into the annular groove 268 of the upper sampler mandrel thereby mutually engaging the upper and lower sampler mandrels. This mutual engagement is maintained through the sliding engagement between the outer cylindrical surfaces 272 of the outwardly extending shoulders 242 of each spring locking finger 240 and the cylindrical inner periphery 274 of the intermediate housing 124 adjacent thereto.

Figure 6C:
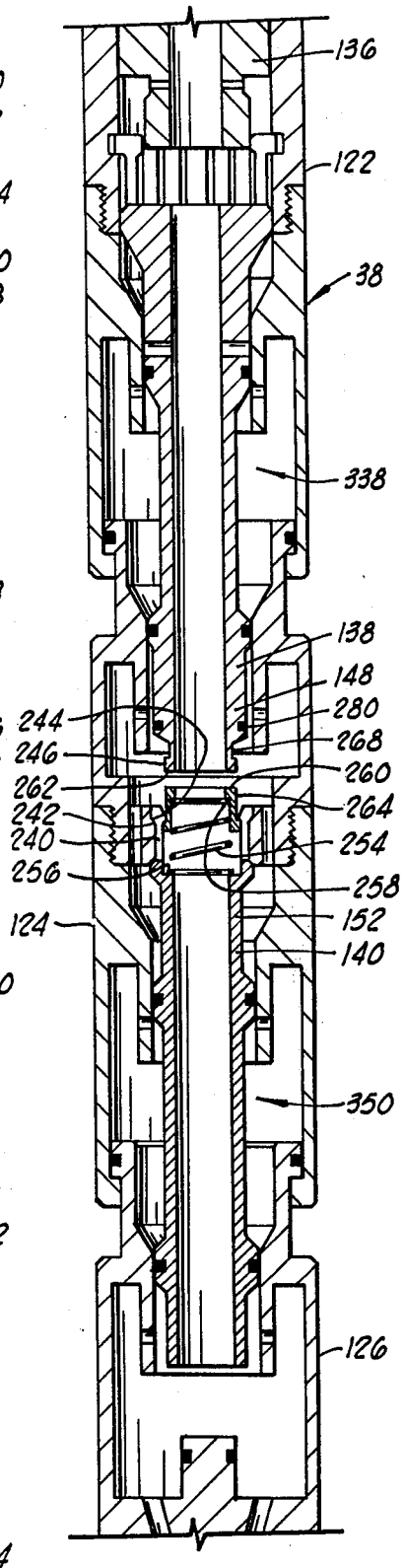
FIG. 6C is an enlarged vertical cross-sectional view of a portion of the drill test string of FIG. 1, similar to FIG. 6B, and illustrating the lower portion of the flow direction valve and expandable sampler assembly when the expandable sampler chambers are closed and the housing assembly is telescopically extended to expand the expandable sampler chambers.

When the housing assembly 118 is longitudinally extended or expanded as shown in FIG. 6C, it will be seen that the locking fingers 240 again engage the lower sampler mandrel 140 to the intermediate housing 124 through the mutual engagement of the outwardly extending shoulders 242 of the spring locking fingers 240 with the annular shoulder 244 of the intermediate housing. Upward movement of the lower sampler mandrel 140 relative to the intermediate housing 124 is physically limited by the abutment of the annular shoulder 276 of the lower sampler mandrel 140 with annular shoulder 278 of the intermediate housing 124. The locking fingers 240 are retained in engagement with the intermediate housing 124 through the mutual sliding engagement between the outer cylindrical surface 264 of the piston 252 and the cylindrically shaped surfaces 248 of each locking finger 240, the piston 252 being biased upwardly into locking position through the extension of compression coil spring 254. With the spring fingers 240 so engaged with the intermediate housing 124, the upper sampler mandrel 138 is free to move an additional distance upwardly relative to the intermediate housing for reasons which will be discussed in detail hereinafter. An annular seal 280 is carried on the lower end portion 148 of the upper sampler mandrel 138 and provides a fluid-tight seal between the upper sampler mandrel 138 and the cylindrical inner periphery 274 of the intermediate housing 124 when the upper sampler mandrel is moved downwardly within the intermediate housing as illustrated in FIG. 7B.

The upper sampler mandrel 138 includes an upper annular seal 282 and a lower annular seal 284 carried in the outer periphery thereof. The upper annular seal provides sliding sealing engagement with the cylindrical inner periphery 286 of the top slide valve cylinder 288 of the expandable sampler chamber assembly 38. Valve ports 290 communicate between the passageway 160 and the outer periphery of the upper sampler mandrel 138 above the annular seal 282. Valve ports 292 are formed in the top slide valve cylinder 288 and communicate between the inner periphery 286 and the outer periphery 294 thereof.

Annular seal 284 provides sliding sealing engagement with the cylindrical inner periphery 296 of upper sampler inlet valve cylinder 298 carried by the intermediate housing 124. Inlet valve ports 300 are formed in the valve cylinder 298 and communicate between the inner periphery 296 and the outer periphery 302 of the valve cylinder 298.

The lower sampler mandrel 140 includes an upper annular seal 304 and a lower annular seal 306 carried on the outer periphery thereof. The upper annular seal 304 provides a sliding seal with the cylindrical inner periphery 308 of the lower sampler outlet valve cylinder 310. The cylinder 310 includes outlet valve ports 312 formed therein communicating between the inner periphery 308 and the outer periphery 314 of the cylinder 310.

The lower annular seal 306 provides a sliding seal between the lower sampler mandrel 140 and the cylindrical inner periphery 316 of the lower sampler inlet valve cylinder 318. Inlet valve ports 320 communicate between the inner periphery 316 and the outer periphery 322 of the inlet valve cylinder 318 of the lower housing 126.

The lower housing 126 includes an upwardly extending valve mandrel 324 which carries an annular seal 326 which selectively provides sliding sealing engagement with the inner periphery of the passageway 162 at the lower end portion 156 of the lower sampler mandrel 140 as shown in FIG. 7B.

The upper end portion 130 of the intermediate housing 124 includes the radially outwardly extending annular flange 328 which is slidably received within a cylindrically shaped chamber 330 formed in the lower end portion 128 of the upper housing 122. An annular seal 322 carried by the flange 328 provides a sliding fluid-tight seal between the flange 328 and the cylindrical inner periphery 334 of the chamber 330. The upper housing 122 and the intermediate housing 124 are retained in sliding telescoping engagement with each other by means of a radially inwardly extending annular flange 336 formed on the lower end portion 128 of the upper housing 122.

The annular chamber defined by the annular space between the upper sampler mandrel 138 and the upper and intermediate housings 122 and 124, and further defined by the annular seals 282, 284 and 332, provides the upper expandable sampler chamber 338 of the flow direction valve and expandable sampler chamber assembly 38.

The upper end portion 134 of the lower housing 126 includes a radially outwardly extending annular flange 340 which is slidably received within a cylindrical chamber 342 formed within the lower end portion 132 of the intermediate housing 124. An annular seal 344 carried by the flange 340 provides a sliding fluid-tight seal between the flange 340 and the cylindrical inner periphery 346 of the chamber 342. The lower housing 126 is retained in sliding telescoping engagement with the intermediate housing 124 by means of a radially inwardly extending annular flange 348 formed on the lower end portion 132 of the intermediate housing 124 and mutually engageable with the annular flange 340 of the lower housing 126. The annular chamber defined by the space between the outer periphery of the lower sampler mandrel 140 and the intermediate and lower housings 124 and 126, and further defined by the annular seals 304, 306 and 344, provides the lower expandable sampler chamber 350 of the flow direction valve and expandable sampler chamber assembly 38.

An annular chamber 352 is formed in the lower housing 126 and communicates with the inlet valve ports 320 of the lower expandable sampler chamber in the valve cylinder 318 as well as with the lower end portion 156 of the lower sampler mandrel 140 and the flow direction valve mandrel 324. Passageways 354 communicate between the annular chamber 352 and a longitudinal passageway 356 which extends through the lower end portion of the lower housing 126.

Fluid communication between the annular seal 284 and the annular seal 304 carried by the mandrel assembly 120 is provided by an upper annular passageway 360, a lower annular passageway 362 and a plurality of longitudinal ports or passageways 364 interconnecting the passageways 360 and 362, all of which are formed within the intermediate housing 124 surrounding the mandrel assembly 120.

FIGS. 6A and 6C illustrate the relative positions of the various elements of the housing assembly 118 and the mandrel assembly 120 of the flow direction valve and expandable sampler chamber assembly 38 when the drill test string 10 is introduced into the well bore to be tested. It will be seen that the operating mandrel 136 is in its uppermost position relative to the upper housing 122 with the lugs 166 in position No. 1 in the respective J-slots 168. The upper sampler mandrel 138 is secured in its uppermost position within the upper housing 122 through the engagement of the locking fingers 222 with the upper housing as described above. The upper, intermediate and lower housings 122, 124 and 126 are mutually telescopically extended to the maximum extent. The lower sampler mandrel 140 is locked in its uppermost position within the intermediate housing 124 through the engagement of the intermediate housing by the locking fingers 240 as described above. The upper and lower sampler chambers 338 and 350 are closed by the annular seals 282 and 284 of the upper sampler mandrel and by the annular seals 304 and 306 of the lower sampler mandrel. It will be seen that the flow direction valve and expandable sampler chamber assembly 38 is completely open to fluid passage therethrough via passageways 158, 160, 162, 354 and 356 as well as the annular chambers 352 and 360.

FIGS. 6A and 6B illustrate the relative positions of the elements of the flow direction valve and expandable sampler chamber assembly 38 when the packer assembly 46 is set prior to the taking of samples from the formation or zone under test. It will be seen that the upper and lower expandable sampler chambers 338 and 350 remain closed by the annular seals carried by the upper and lower sampler mandrels 138 and 140 and the assembly 38 is opened to fluid flow therethrough bypassing the sampler chambers 338 and 350.

FIGS. 7A and 7B illustrate the relative positions of the various elements of the expandable sampler chamber assembly 38 at such time as it is desired to take fluid samples from the zone under test. It will be seen that the operating mandrel 136 is in its lowermost position relative to the upper housing 122 at which time the lugs 166 are in either position No. 2 or position No. 4 in their respective J-slots 168 as shown in FIG. 14. The upper sampler mandrel 138 is released from engagement with the upper housing 122 and is secured to the operating mandrel 136 by means of the spring locking fingers 222 as described above. In a similar manner the lower sampler mandrel 140 is disengaged from the intermediate housing 124 and is secured to the upper sampler mandrel 138 by means of spring locking fingers 240 as also described above.

The flow direction valve mandrel 324 is received within the lower end portion 156 of the lower sampler mandrel 140 with the annular seal 326 in sealing engagement with the inner periphery of the passageway 162. The sealing engagement between the flow direction valve mandrel and the lower sampler mandrel prevents fluid communication between the annular chamber 352 and the passageway 162. The annular seal 306 is positioned below the inlet valve ports 320 thereby providing fluid communication between the annular chamber 352 and the lower sampler chamber 350. The annular seal 304 is positioned below the outlet valve ports 312 thereby placing the lower sampler chamber 350 in fluid communication with the annular passageways 360 and 362 and longitudinal ports or passageways 364 via the outlet valve ports 312. The annular seal 284 is positioned below the inlet valve ports 300 thereby placing the upper annular passageway 360 in communication with the upper expandable sampler chamber 338 via the inlet valve ports 300. The annular seal 282 is positioned below the valve ports 292 in the top slide valve cylinder 288. The valve ports 290 in the upper sampler mandrel are positioned in registration with the valve ports 292 in the top slide valve cylinder 288 thereby placing the upper sampler chamber in communication with the passageway 160 of the upper sampler mandrel 138 which forms a portion of the tubular passageway 154 of the mandrel assembly 120. The relative position of the elements of the expandable sampler chamber assembly 38 illustrated in FIGS. 7A and 7B is achieved by setting drill string weight on the operating mandrel 136 as described above.

It will be readily apparent that when the elements of the assembly 38 are in the positions illustrated in FIGS. 7A and 7B, fluid samples from the zone under test may flow upwardly through the lower and upper sampler chambers 350 and 338 to the drill string above the assembly 38. When it is desired to trap samples within the upper and lower sampler chambers, weight is removed from the operating mandrel 136 to the extent that the upward bias of the compression spring 170 will move the operating mandrel upwardly until the lugs 166 move into either position No. 3 or position No. 5 in the respective J-slots 168. At this time the sampler 38 again assumes the position illustrated in FIGS. 6A and 6B.

It will be seen in FIG. 6B that the upper and lower sampler chambers 338 and 350 are now closed by the annular seals 282, 284, 304 and 306 thus trapping fluid samples from the zone under test therein.

When the drill test string 10 is retrieved from the well bore after testing, the flow direction valve and expandable sampler chamber assembly 38 again assumes the position illustrated in FIGS. 6A and 6C wherein the housing assembly 118 is fully telescopically extended. When in this position, the assembly 38 provides elongation of the upper and lower expandable sampler chambers 338 and 350 thus providing for a substantial reduction in pressure in the well fluid samples trapped therein. The expansion of the upper and lower sampler chambers greatly facilitates the handling of well fluid samples at the ground surface when the drill test string 10 is removed from the well bore thus providing increased safety of operation when taking well fluid tests in extremely deep wells where the zone under test produces well fluids at extremely high temperatures and pressures.

The lower end portion 358 of the lower housing 126 is threadedly secured to the upper end portion of the flow stream recorder assembly 40. The flow stream recorder assembly 40 includes a flow stream recorder 366 carried within a housing 368 and in fluid communication with any fluids passing through the housing 368 via passageway 370 which communicates between the upper and lower ends of the housing 368.

The lower end portion of the housing 368 is threadedly secured to the upper end portion of the hydraulic jar assembly 42 of conventional design. A suitable hydraulic jar assembly for this application is disclosed in U.S. Pat. No. 3,429,389, incorporated by reference herein, and is manufactured and sold by Halliburton Services under the registered trademark BIG JOHN and is further described and illustrated on pages 2556 and 2557 of the Halliburton Services Sales and Service Catalog, Number 37. The hydraulic jar assembly 42 provides means for delivering an impact blow to the drill test string 10 in the event the test string becomes stuck in the well bore.

The lower end portion of the hydraulic jar assembly 42 is threadedly secured to the upper end portion of the upper safety joint assembly 44. The upper safety joint assembly 44 is of conventional construction. A suitable safety joint for this application is disclosed in U.S. Pat. No. 2,877,851, incorporated herein by reference, and known as the VR safety joint manufactured and sold by Halliburton Services and further described and illustrated on page 2557 of the above-identified catalog. The lower end portion of the upper safety joint 44 is threadedly secured to the upper end portion of the packer assembly 46.

Figure 9:
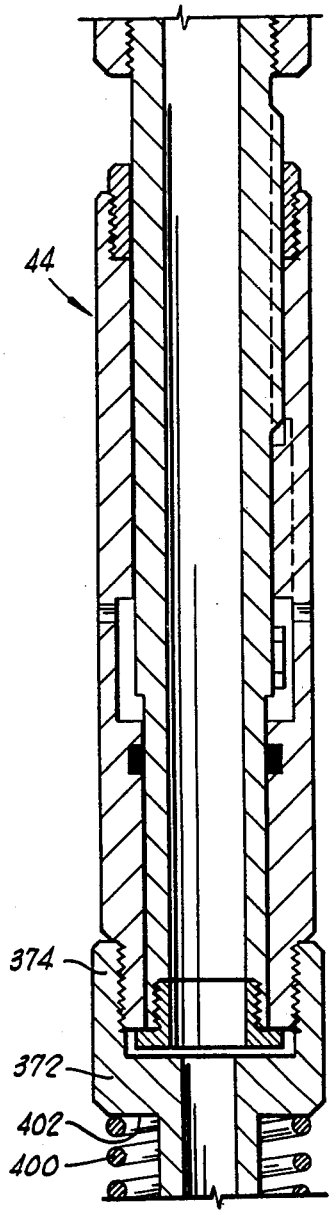
FIG. 9 is an enlarged vertical cross-sectional view of a portion of the drill test string of FIG. 1 illustrating the upper safety joint assembly and the upper end portion of the packer assembly.
Figure 10:
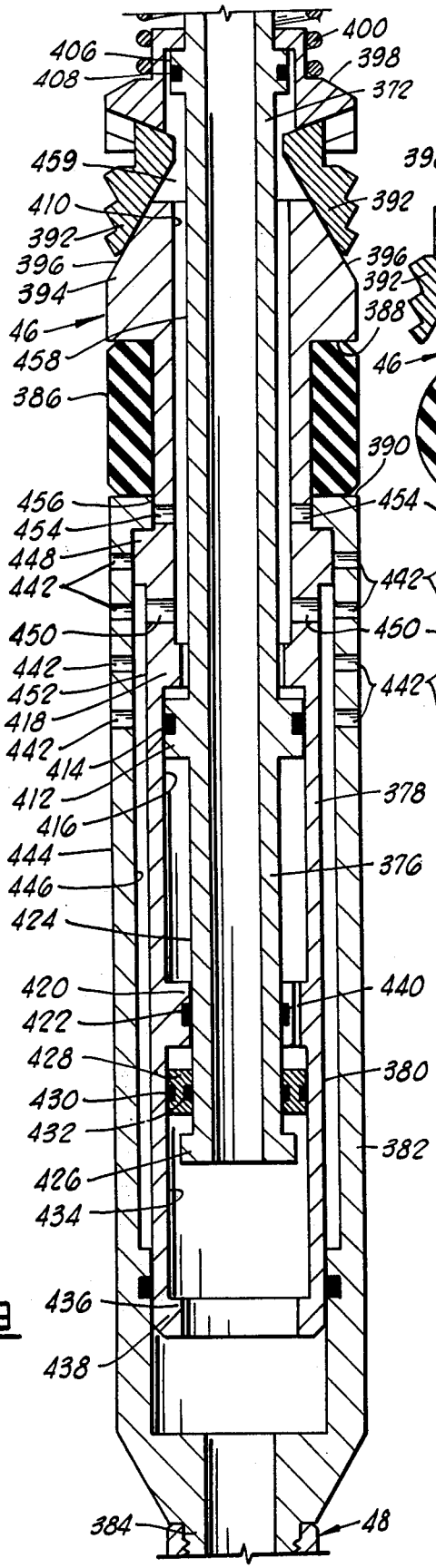
FIG. 10 is an enlarged vertical cross-sectional view of the portion of the drill test string of FIG. 1 illustrating the lower portion of the packer assembly and the upper end portion of the anchor pipe safety joint assembly, with the packer assembly in the unseated position.
Figure 11:
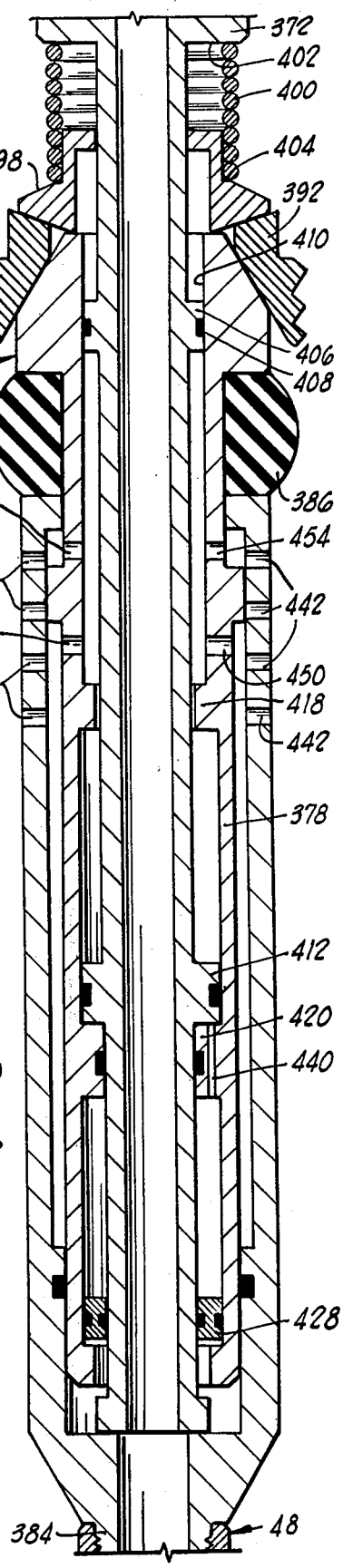
FIG. 11 is an enlarged vertical cross-sectional view of a portion of the dril test string of FIG. 1, similar to FIG. 10 and illustrating the packer assembly in the seated or set position.

Referring now to FIGS. 9, 10 and 11, the packer assembly 46 includes an operating mandrel 372 which is threadedly secured at the upper end 374 thereof to the lower end portion of the upper safety joint 44. The lower portion 376 of the operating mandrel is slidably received within a tubular packer mandrel 378. The lower end portion 380 of the packer mandrel is slidably received within the tubular packer housing 382 the lower end portion 384 of which is threadedly secured to the upper end portion of the lower or anchor pipe safety joint assembly 48. An annular elastomeric or rubber compression packer element 386 is disposed around the packer mandrel 378 and is positioned between a downwardly facing shoulder 388 formed on the packer mandrel and an upwardly facing annular shoulder 390 formed on the packer housing such that as the shoulders 388 and 390 of the packer mandrel and packer housing are moved relatively toward each other, the packer element 386 is compressed and thereby expanded radially outwardly as shown in FIG. 11 to seal against the wall of the well bore as shown in FIG. 1.

A plurality of locking slips 392 are disposed in circumferentially spaced relation about the upper end portion 394 of the packer mandrel 378 each in slidable relation to a respective inclined surface 396 formed on the upper end portion 394 of the packer mandrel. An annular slip mounting member 398 is disposed around the operating mandrel 372 to provide suitable means for securing the slips 392 to the packer assembly 46.

A compression coil spring 400 extends between the downwardly facing annular shoulder 402 formed on the operating mandrel 372 and an upwardly facing annular shoulder 404 formed on the slip mounting member 398.

The operating mandrel 372 includes a radially outwardly extending annular flange 406 having an annular seal 408 mounted thereon. The annular flange 406 and seal 408 are sized to be slidingly sealingly received within the upper cylindrical inner surface 410 formed in the packer mandrel 378 when the packer is set as illustrated in FIG. 11. The annular flange 406 is positioned above the cylindrical inner surface 410 when the packer assembly is unseated as shown in FIG. 10.

A second radially outwardly extending annular flange 412 is formed on the operating mandrel 372 a distance below the flange 406 and includes an annular seal 414 carried therein. The flange 412 and seal 414 provide a sliding fluid-tight seal with an intermediate cylindrical inner surface 416 formed in the packer mandrel 378. The surface 416 extends between a radially inwardly extending upper flange 418 and a radially inwardly extending intermediate flange 420 formed in the packer mandrel 378. The flange 420 carries an annular seal 422 which provides a sliding fluid-tight seal with the cylindrical outer periphery 424 of the operating mandrel which extends between the intermediate annular flange 412 and a lower radially outwardly extending annular flange 426 formed on the lower end of the operating mandrel.

An annular pressure equalization piston 428 having annular seals 430 and 432 mounted thereon is disposed around the operating mandrel intermediate the lower flange 426 thereof and the flange 420 of the packer mandrel. The piston 428 provides a sliding fluid-tight seal between the cylindrical outer periphery 424 of the operating mandrel and the lower cylindrical inner surface 434 formed in the packer mandrel and extending between the flange 420 and the lower radially extending annular flange 436 formed on the lower end 438 of the packer mandrel. One or more passageways 440 having a predetermined cross-sectional area extend longitudinally through the flange 420.

The annular space between the operating mandrel 372 and the packer mandrel 378 intermediate the annular seals 414, 430 and 432 and interconnected by the passageways 440 defines a conventional hydraulic impedance chamber preferably filled with oil. The hydraulic impedance mechanism retards the relative longitudinal movement between the operating mandrel 372 and the packer mandrel 378.

The packer housing 382 includes a plurality of ports 442 formed therein and extending between the outer periphery 444 and a cylindrical inner surface 446 of the packer housing. A radially outwardly extending annular flange 448 is formed on the outer periphery of the packer mandrel 378. A plurality of ports 450 are formed in the packer mandrel and communicate between the upper cylindrical surface 410 and the cylindrical outer periphery 452 of the packer mandrel. A plurality of ports 454 are formed in the packer mandrel and communicate between the upper cylindrical inner surface 410 and the cylindrical outer periphery 456 of the packer mandrel.

When the packer assembly 46 is in the relaxed or unseated position, as when the drill test string 10 is going into the well bore or at such time as the packer assembly 46 is being unseated by lifting the drill test string 10 and the operating mandrel 372, it will be seen that fluid communication is provided bypassing the packer element 386 via the ports 442 and 450 and the annular passageway between the cylindrical surface 446 and outer periphery 452, and the annular passageway between the cylindrical surface 410 and the cylindrical outer periphery 458 of the operating mandrel through openings around the locking slips 392 as shown at 459. This bypassing action permits pressure equalization around the packer element 386 if the packer element remains sealingly engaged with the wall of the well bore after an unsuccessful attempt to unseat the packer assembly 46. This bypassing action also permits circulation or reverse circulation through the packer assembly 46 even tough the packer element 386 fails to unseat.

It will be seen in FIG. 11 that when the packer assembly 46 is seated and the packer element 386 is expanded to sealingly engage the wall of the well bore, the flange 406 and the annular seal 408 of the operating mandrel seal against the cylindrical inner surface 410 of the packer mandrel thereby preventing fluid bypass around the packer element 386. It will also be seen in FIG. 11 that the operating mandrel 372, after suitable hydraulic delay, forces the packer mandrel 378 downwardly relative to the packer housing 382 through the mutual engagement of the flanges 412 and 420 of the operating mandrel and packer mandrel, respectively.

It will be further seen in FIG. 11 that when the operating mandrel 372 is forced downwardly relative to the packer housing 382 to set the packer, the compression coil spring 400 is compressed thereby forcing the slip mounting member 398 downwardly which, in turn, forces the locking slips 392 radially outwardly into engagement with the wall of the well bore to lock the packer assembly 46 in its seated or set position in the well bore.

The lower or anchor pipe safety joint assembly 48, the upper end of which is threadedly secured to the lower end portion 384 of the packer housing 382, is of conventional design. An anchor pipe safety joint manufactured and sold by Halliburton Services and illustrated at page 2557 in the Halliburton Services Sales and Service Catalog, Number 37 may be suitably employed in this application. The anchor pipe safety joint assembly provides means for releasing the test string in the event the portion below the packer assembly becomes stuck in the well bore.

The lower end of the anchor pipe safety joint assembly 48 is threadedly secured to the upper end of the perforated anchor pipe 50 which is of conventional construction and may be either slotted or perforated. The lower end of the anchor pipe 50 is threadedly secured to the upper end of the check valve assembly 52. The check valve assembly 52 includes a valve body 460 having a longitudinal passageway 462 extending therethrough. The upper end portion 464 of the longitudinal passageway includes a downwardly facing conical valve seat 466 formed therein. The longitudinal passageway 462 is intersected by a plurality of relatively large diameter ports 468 formed in the housing 460 which communicate between the passageway 462 and the exterior of the housing. A longitudinal valve member 470 is longitudinally slidably disposed within the passageway 462 and includes a conically shaped valve head 472 formed thereon which sealingly engages the valve seat 466 through the upward urging of the compression coil spring 474.

The check valve assembly 52 provides means for relieving pressure within the drill test string 10 in the event the perforations in the anchor pipe 50 become plugged during sample testing thereby preventing the pumping of well fluid from the zone under test back into the zone through the anchor pipe. In the event the anchor pipe is so plugged, increased pressure within the drill test string 10 causing a pressure differential across closed valve will force the valve member 470 downwardly within the valve body 460 thereby providing fluid release from the interior of the drill test string through the ports 468 into the zone under test.

The lower end of the check valve assembly 52 is threadedly secured to the upper end of the maximum temperature thermometer assembly 54. The maximum temperature thermometer assembly includes a housing 476 within which a maximum temperature thermometer 478 is disposed. A port 480 provides fluid communication between the exterior of the housing 476 and the thermometer 478.

The lower end of the maximum temperature thermometer assembly 54 is threadedly secured to the upper end of a conventional temperature recorder assembly 56. A suitable temperature recorder for use in this application is available from Halliburton Services and is designated as the HT-500 Temperature Recorder and is illustrated on page 2554 of the Halliburton Services Sales and Service Catalog, Number 37.

The lower end of the temperature recorder assembly 56 is threadedly secured to the upper end of the upper blanked-off pressure recorder assembly 58. The assembly 58 includes a housing 482 within which a Bourdon tube pressure recording device 484 is housed. Fluid communication between the exterior of the housing 482 and the recording device 484 is provided by port 486 formed in the housing 482. A suitable Bourdon tube pressure recording device is available from Halliburton Services and is illustrated in the Halliburton Services Sales and Service Catalog, Number 37 at page 2554.

The lower end of the upper blanked-off pressure recording assembly 58 is threadedly secured to the upper end of the tubular spacer element 60. The tubular spacer element 60 is of a preselected length to provide suitable spacing between the upper blanked-off pressure recording assembly 58 and the lower blanked-off pressure recording assembly 62, the upper end of which is threadedly secured to the lower end of the tubular spacer element 60. The lower blanked-off pressure recorder assembly 62 is substantially identical to the upper blanked-off pressure recorder assembly 58. The lower end of the lower blanked-off pressure recorder assembly 62 is secured to the anchor shoe 64 which provides suitable means for engaging the bottom of the well bore with the drill test string 10.

Operation

In operation the drill test string 10 is lowered into a well bore which intercepts a zone in a formation which zone contains well fluids which require testing and of which it is desired to obtain samples. The drill test string 10 is lowered into the well bore with the flow direction valve and expandable sampler chamber assembly 38 in the open position as illustrated in FIGS. 6A and 6C. It will be understood that the well bore at the time of introduction of the drill test string 10 contains a column of mud which exerts sufficient hydrostatic pressure on the zone under test to exceed the formation pressure and to retain the formation fluids in the formation to thereby prevent their entry into the well bore. It will be understood, further, that the drill test string is completely open from bottom to stop so that it will fill with mud as the drill test string is lowered into the well bore.

When the drill test string 10 is completely lowered into the well bore, with the anchor shoe 64 engaging the bottom of the well bore the transverse passage 70 of the sleeve type safety valve assembly 18 is connected by means of conduit 486 and a valve 488 to a suitable pump 490 connected to a displacement fluid reservoir 492. The transverse passageway 86 of the flow cross kill line connection assembly 22 is connected by means of a suitable conduit 494 and valve 496 to a suitable pump 498 which is in turn connected to a suitable reservoir 500 for mud or the like.

With packer assembly 46 in its unseated position, as illustrated in FIG. 10, and with the sampler chamber assembly 38 in its open or flowing position as illustrated in FIGS. 6A and 6B, valve 488 is opened and valve 496 is closed and cylindrical valve member 72 of the sleeve type safety valve assembly 18 is maintained in its uppermost open position. The pump 490 is then started and forces a predetermined quantity of displacement fluid, preferably diesel oil, through the conduit 486 and open valve 488 downwardly through the drill test string 10 to displace the heavier mud downwardly through the drill test string and out through the perforations in the perforated anchor pipe 50 and upwardly through the annulus between the drill test string 10 and the well bore with excess mud flowing to the mud reservoir 500 through conduit 502 and open valve 504. The volume of displacement fluid pumped downwardly through the drill test string 10 is predetermined such that the hydrostatic head within the drill test string acting on the zone under test after the introduction of the predetermined volume of displacement fluid is less than the formation pressure in the zone under test.

At this point, while holding pressure on the column of fluid in the drill test string or conduit means, the packer assembly 46 is set by setting drill test string weight on the packer assembly thereby isolating the annulus above the packer assembly 46 from the zone under test. It will be understood that during the setting of the packer assembly 46 pressure is retained on the liquid column within the drill test string 10 by closing the valve 488.

When the packer assembly 46 is set, the upper end lower expandable sampler chambers 338 and 350 are opened by setting drill test string weight on the sampler chamber assembly 38 thus placing the elements thereof in the positions illustrated in FIGS. 7A and 7B. It will be understood that this opening of the expandable sampler chambers 338 and 350 is accompanied by movement of the lugs 166 from position No. 1 to position No. 2 in the respective J-slots 168 as illustrated in FIG. 14.

The hydraulic pressure acting on the zone under test is then reduced by opening the valve 488 a predetermined amount to allow the formation pressure in the zone under test, which, as noted above, is greater than the hydrostatic pressure of the fluid column within the drill test string 10, to displace the fluid column within the drill test string 10 upwardly allowing a portion of the displacement fluid to flow through the conduit 486 and the open valve 488 back to the reservoir 492. When a sufficient volume of displacement fluid has been forced through the conduit 486 and valve 488 back to the reservoir 492 to assure that well fluids from the zone under test have passed upwardly through the drill test string 10, including the open expandable sampler chambers 350 and 338, to a position above the expandable sampler chamber assembly 38, the valve 488 is closed. During the period of time when well fluids are flowing from the formation in the zone under test into the perforated anchor pipe 50 and upwardly through the lower portion of the drill test string 10, temperature and pressure readings are taken and recorded by the maximum temperature thermometer assembly 54, the temperature recorder assembly 56, the upper blanked-off pressure recorder assembly 58 and the lower blanked-off pressure recorder assembly 62.

To secure samples of the well fluid from the formation in the zone under test, the expandable sampler chambers 438 and 450 are closed trapping samples therein by lifting drill test string weight from the expandable sampler chamber assembly 38 and placing the various elements thereof in the positions illustrated in FIGS. 6A and 6B. It will be understood that during the closure of the sampler chambers thus described, the lugs 166 move from position No. 2 to position No. 3 in the respective J-slots 168 as illustrated in FIG. 14.

In the event of some unforeseen malfunction in the abovedescribed sampling procedure, the expandable sampler chambers 338 and 350 may be opened one more time in a manner as described above which will occasion the movement of the lugs 166 from a position No. 3 to position No. 4 within the respective J-slots as illustrated in FIG. 14. Similarly, samples may be trapped in the expandable sampler chambers 338 and 350 by reducing the drill test string weight on the expandable sampler chamber assembly 38 a second time thereby again placing the elements thereof in the position illustrated in FIGS. 6A and 6B causing the movement of the lugs 166 from position No. 4 to position No. 5 in the respective J-slots 168 as again illustrated in FIG. 14. Any additional vertical manipulation of the drill test string 10 relative to the expandable sampler chamber assembly 38 will not again open the expandable sampler chambers 438 and 450, and the lugs 166 will move vertically only between position No. 5 and position No. 6 in the J-slots 168 and as illustrated in FIG. 14.

After the well fluid samples have been trapped in the expandable sampler chambers 338 and 350, it is deemed preferable to open the valve 488 and actuate the pump 490 to increase the hydraulic pressure within the drill test string 10 to force the remaining formation fluid in the drill test string from the lower end thereof back into the formation in the zone under test. When the hydraulic pressure above and below the set packer has become equalized, the packer assembly 46 may be unseated and mud may be pumped into the annulus between the drill test string 10 and the well bore from the mud reservoir 500 by the pump 498 through conduit 502 and open valve 504 to reverse circulate mud through the perforated anchor pipe 50 and displace the displacement fluid from the drill test string through conduit 486 and valve 488 into the displacement fluid reservoir 492. The valve 488 will be suitably manipulated at the ground surface to maintain pressure in the drill test string at a level greater than the formation pressure of the zone under test during this reverse circulation. When the predetermined known volume of displacement fluid has been returned to the displacement fluid reservoir 492, and when any residual formation fluid from the zone under test has been removed from the drill test string through conduit 506 and valve 508 to a suitable reservoir 510, sufficient mud will be disposed within the well bore to exceed the formation pressure thus allowing the drill test string 10 to be removed from the well bore with the well fluid samples secure in the sampler chamber 338 and 350. It will be understood that upon withdrawal of the drill test string 10 from the well bore, the expandable sampler chambers 338 and 350 will be expanded to substantially increase the volumes thereof and thereby reduce the pressure of the well fluid samples trapped therein as illustrated in FIG. 6C.

In the event it is found to be impossible or undesirable to pump the well fluids from the zone under test back into the formation from which they came, the same process as described above may still be employed although a greater volume of well fluids will have to be controlled at the ground surface through conduit 506 and valve 508 to the reservoir 510. It will also be understood that, if desired, the well fluids may be removed by circulating mud down the drill test string 10 through the anchor pipe 50 and up through the annulus with the pump 498.

In the event the packer assembly 46 becomes stuck and cannot be unseated in the well bore, it will be noted that normal circulation or reverse circulation of the mud may still be maintained around the packer assembly 46 through the opening 459, annular space between the upper cylindrical inner surface 410 and the cylindrical outer periphery 458, and ports 454, 450 and 442 of the packer assembly 46. The drill test string may then be released from the packer assembly through the actuation of the upper safety joint 44 in the usual conventional manner.

It should also be noted that, in the event the well fluids cannot be pumped back into the formation in the zone under test, the displacement fluid in the drill test string 10 may be removed therefrom by reverse circulating the mud from the pump 498 down the annulus and through the anchor pipe 50 or through the previously actuated sleeve impact reversing sub 30. When the drill test string 10 is removed from the well bore the flow direction valve and expandable sampler chamber assembly 38 may be disassembled therefrom and removed from the well site to a suitable controlled environment where the well fluid samples trapped in the upper and lower expandable sampler chambers 338 and 350 may be removed by suitable means (not shown) for further testing and evaluation.

It should be understood that the method and apparatus of the invention may be altered, if desired to utilize only one sampler chamber or to utilize a non-expandable sampler chamber in substitution for one or both of the expandable sampler chambers 338 and 350.

Figure 15:
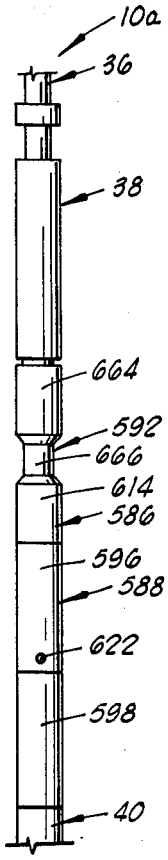
FIG. 15 is an elevational view illustrating an alternate embodiment of the drill test string of the present invention having a rotation type circulating valve assembly interposed between the flow direction valve and expandable sampler chamber assembly and the flow stream recorder assembly.

FIG. 15 illustrates an alternative form of the drill test string of the present invention which is generally designated by the reference character 10*a*. The drill test string 10*a* includes a rotation type circulating valve assembly 586 interposed therein between the lower end of the flow direction valve and expandable sampler chamber assembly 38 and the upper end of the flow stream recorder assembly 40. The remainder of the drill test string 10*a* is substantially identical to the drill test string 10 described in detail above.

Figure 19:
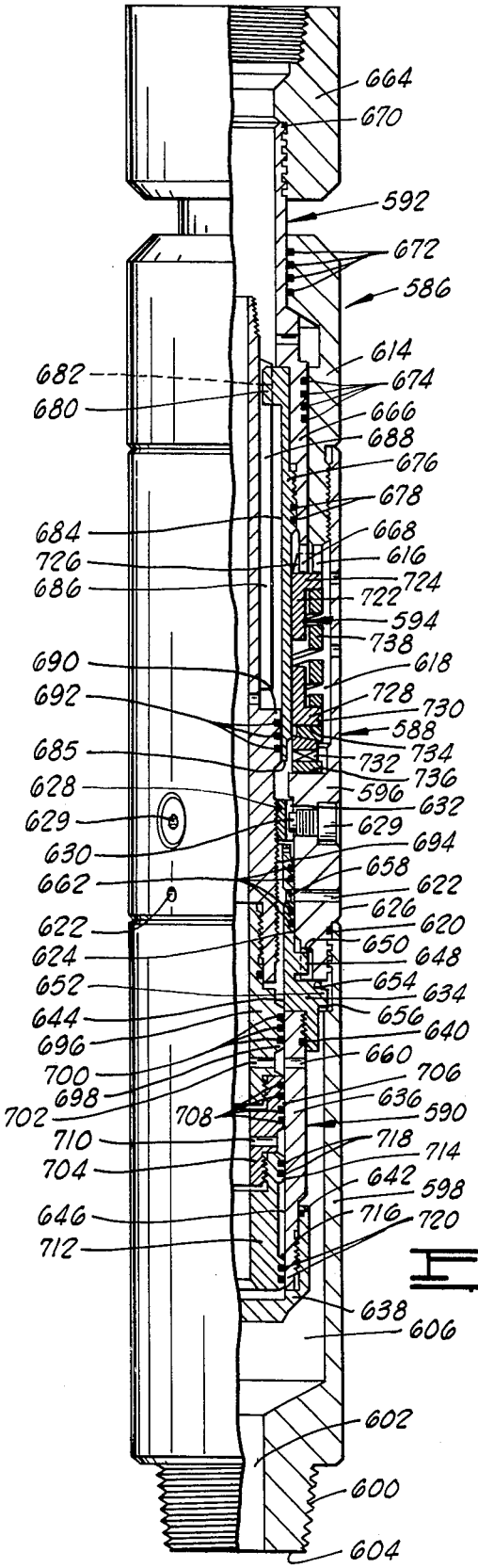
FIG. 19 is an enlarged partial vertical cross-sectional view of the rotation type circulating valve assembly shown in FIGS. 15, 16, 17 and 18.

Referring to FIGS. 15 and 19, the rotation type circulating valve assembly 586 comprises a case assembly 588, a valve cylinder assembly 590, an operating mandrel assembly 592 and a clutch assembly 594.

The case assembly 588 includes a tubular cylindrical upper case 596 threadedly secured at its lower end to the upper end portion of a cylindrical lower case 598. External threads 600 are formed on the lower end of the case assembly for threaded engagement with the next lower component in the drill test string. A passage 602 communicates between the lower end face 604 of the lower case 598 and a cavity 606 formed in the lower case.

The case assembly 588 further includes a tubular cap 614 threadedly secured at its lower end portion to the upper end portion of the upper case 596. The cap 614 includes a plurality of downwardly extending lugs 616 formed on the lower end thereof and extending into an annular cavity 618 formed within the upper case 596. An annular sealing member 620 provides a fluid-tight seal between the lower end portion of the upper case 596 and the upper end portion of the lower case 598. A plurality of circulating ports 622 are formed in the upper case 596 communicating between a cylindrical inner surface 624 and the outer surface 626 thereof. An internally threaded control nut 628 is disposed within the upper case 596 and is maintained in nonrotating relation thereto by means of a plurality of retainer bolts 629 threadedly secured in the upper case 596 with the inner end portions 630 thereof received in respective longitudinal grooves 632 formed in the outer periphery of the control nut 628.

The valve cylinder assembly 590 includes an upper valve cylinder 634, a lower valve cylinder 636 and a cylinder cap 638. The lower end portion of the upper valve cylinder 634 is threadedly secured to the upper end portion of the lower valve cylinder 636. The cylinder cap 638 is threadedly secured to the lower end portion of the lower valve cylinder 636. An annular sealing member 640 provides a fluid-tight seal between the upper and lower valve cylinders and an annular sealing member 642 provides a fluid-tight seal between the cylinder cap and the lower valve cylinder. The cylindrical inner surface 644 of the upper valve cylinder and the cylindrical inner surface 646 of the lower valve cylinder are coaxially aligned and are of substantially equal diameter.

The upper valve cylinder 634 is maintained in nonrotating relation to the upper case 596 by means of radially outwardly extending lugs 648 formed on the upper valve cylinder and received in corresponding recesses 650 formed in the upper case 596. The mutual engagement of the lugs 648 and recesses 650 maintains the entire valve cylinder assembly 590 in nonrotating relation to the case assembly 588.

The valve cylinder assembly 590 is maintained in fixed longitudinal relation with the case assembly 588 by means of a radially outwardly extending flange 652 disposed between the lower end face 654 of the upper case 596 and an upwardly extending annular shoulder 656 formed within the lower case 598.

At least one radially extending valve port 658 extends through the upper valve cylinder 634 in registration with the circulating ports 622 in the upper case 596. At least one radially extending port 660 extends through the wall of the lower valve cylinder 636. Annular sealing members 662 provide a fluid-tight seal between the upper valve cylinder 634 and the upper case 596 thus providing fluid-tight communication between the ports 658 and the ports 622.

The operating mandrel assembly 592 includes an internally threaded tubular coupling 664 adapted to threadedly secure the circulating valve assembly 586 to the element next above in the drill test string. The lower end portion of the coupling 664 communicates with and is threadedly secured to the upper end portion of a tubular neck 666. Downwardly extending lugs 668 are formed on the lower end of the neck 666. An annular sealing member 670 provides a fluid-tight seal between the coupling 664 and the neck 666. A plurality of annular sealing members 672 and 674 provide a sliding fluid-tight seal between the neck 666 and the cap 614. An upper cylinder 676 is threadedly secured to the lower end portion of the neck 666. Annular sealing members 678 provide a fluid-tight seal between the neck 666 and the upper cylinder 676. A radially inwardly extending flange 680 is formed on the upper end portion of the upper cylinder 676 and includes a plurality of longitudinal grooves 682 formed therein. A cylindrical inner surface 684 communicates between the flange 680 and the lower end face 685 of the upper cylinder.

A tubular control screw 686 is longitudinally slidably disposed within the upper cylinder 676. The control screw 686 includes a plurality of radially outwardly extending longitudinal ribs 688 longitudinally slidably received in the corresponding grooves 682 of the upper cylinder 676 to prevent relative rotation therebetween while providing for relative longitudinal displacement therebetween. A radially outwardly extending flange 690 is formed on the control screw 686 and carries a plurality of annular sealing members 692 providing a sliding fluid-tight seal between the control screw 686 and the inner surface 684 of the upper cylinder 676. The control screw 686 includes an externally threaded portion 694 formed on the lower end portion thereof and threadedly engaged with the internally threaded control nut 628. The internal thread of the control nut 628 and the externally threaded portion of the control screw 686 are preferably in the form of a left-hand thread while the threaded surfaces of the remainder of the circulating valve assembly 596 are preferably right-hand thread.

The operating mandrel assembly 592 further includes a tubular valve mandrel upper extension 696 threadedly secured at its upper end portion to the lower end portion of the control screw 686. The valve mandrel upper extension 696 includes a radially outwardly extending flange 698 carrying a plurality of annular sealing members 700 which provide a sliding, fluid-tight seal between the valve mandrel upper extension 696 and the cylindrical inner surface 644 of the upper valve cylinder 634. At least one radially extending port 702 extends through the wall of the valve mandrel upper extension 696. The lower end portion of the valve mandrel upper extension 696 is threadedly secured to the upper end portion of the valve mandrel center section 704. The valve mandrel center section 704 includes a radially outwardly extending cylindrical flange 706 carrying a plurality of annular sealing members 708 which provide a sliding fluid-tight seal between the valve mandrel center section and the cylindrical inner surface 646 of the lower valve cylinder 636. At least one radially outwardly extending port 710 is formed in the valve mandrel center section and extends through the wall thereof. The lower end portion of the valve mandrel center section 704 is threadedly secured to the upper end portion of the tubular valve mandrel lower section 712. The valve mandrel lower section 712 includes an upper radially outwardly extending cylindrical flange 714 and a lower radially outwardly extending cylindrical flange 716. The flange 714 carries a plurality of annular sealing members 718 which provide a sliding fluid-tight seal between the valve mandrel lower section 712 and the cylindrical inner surface 646 of the lower valve cylinder 636. Similarly, the flange 716 carries a plurality of annular sealing members 720 which provide a sliding fluid-tight seal between the valve mandrel lower section 712 and the cylindrical inner surface 646.

The clutch assembly 594 includes an annular clutch jaw 722 having a radially outwardly extending flange 724 formed thereon. A plurality of circumferentially spaced recesses 726 are formed on the upper surface of the flange 724 and are sized and shaped to receive the downwardly extending lugs 616 of the cap 614 and the downwardly extending lugs 668 of the neck 666 therein. An annular limit spacer 728 is disposed around the upper cylinder 676 and includes a radially outwardly extending flange 730 formed thereon. A suitable roller thrust bearing 732 is disposed around the upper cylinder 676 between the lower end face 734 of the limit spacer 728 and an upwardly facing annular shoulder 736 formed in the upper case 596. A compression coil spring 738 is positioned within the annular cavity 618 and extends between the flange 724 of the clutch jaw 722 and the flange 730 of the limit spacer 728.

The rotation type circulating valve assembly 586 operates in the following manner. The various elements of the circulating valve assembly 586 are initially placed in the relative positions illustrated in FIG. 19 when the drill test string is assembled and run in the hole. It will be seen that the valve assembly 586 is open to fluid flow therethrough in the initial position. Fluid may pass through the passage 602, cavity 606, ports 660 and 702 into the interior of the valve assembly and upwardly therefrom through the tubular coupling 664 into the element next above in the drill test sting. It will also be noted that the case assembly 588 and the operating mandrel assembly 592 are maintained in non-rotating relation one with the other through the action of the clutch assembly 594. The compression coil spring 738 biases the clutch jaw 722 upwardly forcing the recesses 726 thereof into mutual engagement with the downwardly extending lugs 616 and 668 of the case assembly 588 and operating mandrel assembly 592. This arrangement allows the operator to rotate the drill test string during manipulation thereof without affecting the initial setting of the various elements of the circulating valve assembly 586 until so desired.

When the packer assembly of the drill test string is set, the operator may commence operation of the circulating valve assembly 586 by setting sufficient drill string weight down on the operating mandrel assembly 592 and applying this force through the lower end of the tubular neck 666 thereof to the clutch jaw 722 to move the clutch jaw 722 downwardly overcoming the upward bias of the compression coil spring 738. When sufficient drill string weight has been set down on the operating mandrel assembly 592 to move the clutch jaw 722 downwardly out of engagement with the lugs 616 of the cap 614 of the case assembly 588, the operating mandrel assembly 592 is free to rotate relative to the case assembly 588.

The circulating valve assembly 586 may then be actuated from the open position to a closed position by rotating the operating mandrel assembly 592 relative to the case assembly 588 in a right-hand direction to a predetermined number of turns, preferably approximately eleven turns. This rotation causes the left-hand threaded control screw 686 to move upwardly relative to the control nut 628 positioning the upper pair of annular sealing members 708 above the ports 660 and the lower pair of annular sealing members 708 below the ports 660. The circulating valve assembly 586 may be activated from the closed position to a second open position through further rotation of the operating mandrel assembly 592 relative to the case assembly 588, the number of additional turns preferably being approximately fourteen. At this point the ports 710 and 660 are in substantial radial alignment with the lower pair of annular sealing members 708 positioned above the ports 660 and with the annular seals 718 positioned below the ports 660.

The circulating valve assembly 586 may again be actuated from an open position to a closed position by additional rotation of the operating mandrel assembly 592 relative to the case assembly 588, the additional rotation preferably being approximately fourteen turns. At this point the annular sealing members 718 are positioned just above the ports 660 and the annular sealing members 720 are positioned some distance below the ports 660. Also at this time the annular sealing members 700 are positioned below the ports 658.

When it is desired to circulate through the circulating valve assembly 586, the valve assembly may be opened to circulation by rotating the operating mandrel assembly 592 relative to the case assembly 588 an additional amount, such rotation preferably being approximately an additional sixteen turns. At this point, the annular sealing members 718 are positioned a greater distance above the ports 660 while the annular sealing members 720 are positioned below but nearer to the ports 660. The ports 702 will then be in substantial radial alignment with the ports 658 and 622 with the annular sealing members 700 positioned above the ports 658 and with the annular sealing members 708 positioned below the ports 658. Additional rotation of the operating mandrel assembly 592 relative to the case assembly 588 will have no effect on the longitudinal displacement of the control screw 686 relative to the control nut 628 since the control nut 628 will then be positioned intermediate the external threads of the control screw 686 and the flange 698. Fluid flow through the valve assembly from elements of the drill string therebelow is completely blocked by the operating mandrel assembly 592 and the valve cylinder assembly 590 when the valve assembly is opened for circulation through the circulating ports 622.

It will be understood that the use of the rotation type circulating valve assembly 586 as described above will permit the performance of two closed-in pressure tests with the drill test string in which the valve assembly is employed. It will be readily apparent that the valve assembly may be modified or pre-assembled to provide a single closing of the valve assembly prior to opening the valve assembly to the circulation therethrough. It will further be apparent that the valve assembly may be further modified or pre-assembled to provide means for opening the valve assembly to circulation therethrough without employing any of the valve opening and closing structure described above.

After operation of the circulating valve assembly 586 the drill string weight may be removed from the operating mandrel assembly 592 until the upward bias of the compression coil spring 738 is sufficient to reengage the lugs 616 and 658 with the clutch jaw 722 thereby permitting rotation to be transmitted through the circulating valve assembly 586 to the elements of the drill test string therebelow.

Figure 16:
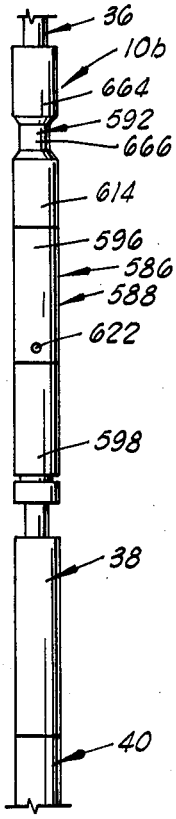
FIG. 16 is an elevational view illustrating an alternate embodiment of the drill test string of the present invention having a rotation type circulating valve assembly interposed therein immediately above the flow direction valve and expandable sampler chamber assembly.

FIG. 16 illustrates an alternate embodiment of the drill test string of the present invention which is generally designated by the reference character 10*b*. The drill test string 10*b* includes a rotation type circulating valve assembly 586 interposed therein between the upper end of the flow direction valve and expandable sampler chamber assembly 38 and the lower end of the drill pipe 36. The remainder of the drill test string 10*b* is generally identical to the drill test string 10 described in detail above.

Figure 17:
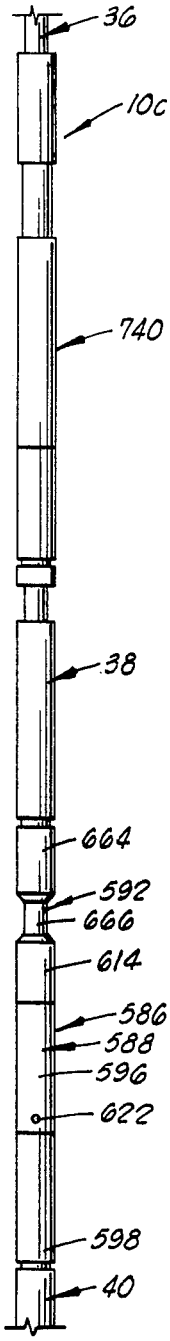
FIG. 17 is an elevational view illustrating an alternate embodiment of the drill test string of FIG. 15 having a longitudinally reciprocable tester valve assembly interposed therein immediately above the flow direction valve and expandable sampler chamber assembly.

FIG. 17 illustrates another form of the drill test string of the present invention which is generally designated by the reference character 10*c*. The drill test string 10*c* includes a longitudinally reciprocable tester valve assembly 740 interposed therein immediately above the flow direction and expandable chamber assembly 38 and a rotation type circulating valve assembly 586 interposed therein between the lower end of the flow direction valve and expandable chamber assembly 38 and the upper end of the flow stream recorder assembly 40. A suitable tester valve for use as the tester valve assembly 740 is the HYDROSPRING tester manufactured by Halliburton Services. Such apparatus is disclosed in U.S. Pat. No. 2,740,479 to H. E. Schwegman, as modified by U.S. Pat. No. 3,105,553 to P. T. W. Chisholm, which patents are incorporated herein by reference. As an alternative, HYDROSPRING tester having no bypass passages formed therein may be employed in the drill test string. The remainder of the drill test string 10*c* is substantially identical to the drill test string 10 described in detail above.

Figure 17A:
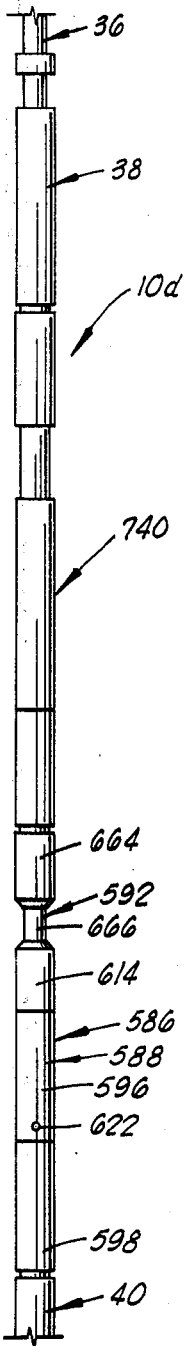
FIG. 17A is an elevational view illustrating an alternate embodiment of the drill test string of FIG. 17 having the longitudinally reciprocable tester valve assembly interposed therein immediately below the flow direction valve and expandable sampler chamber assembly.

FIG. 17A illustrates another form of the drill test string similar to that illustrated in FIG. 17 which is generally designated by the reference character 10*d*. The drill test string 10*d* includes a longitudinally reciprocable tester valve assembly 740 interposed therein immediately below the flow direction and expandable sampler chamber assembly 38 and a rotation type circulating valve assembly 586 interposed therein between the lower end of the tester valve assembly 740 and the upper end of the flow stream recorder assembly 40. The remainder of the drill test string 10*d* is substantially identical to the drill test string 10 described in detail above.

Figure 18:
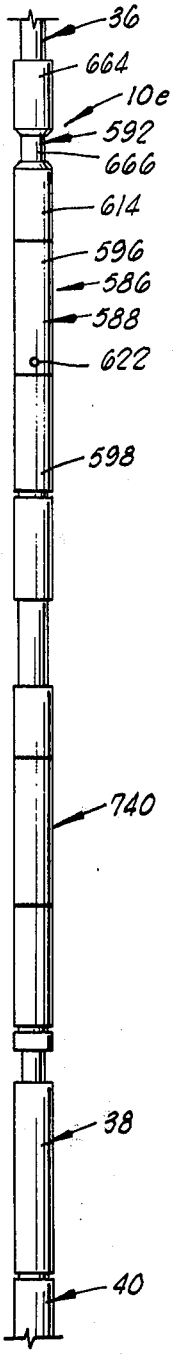
FIG. 18 is an elevational view illustrating an alternate embodiment of the drill test string of FIG. 16 having a longitudinally reciprocable tester valve assembly interposed between the flow direction valve and expandable sampler chamber assembly and the rotation type circulating valve assembly.

FIG. 18 illustrates still another form of the drill test string of the present invention which is generally designated by the reference character 10*e*. The drill test string 10*e* includes a longitudinally reciprocable tester valve assembly 740 interposed therein immediately above the flow direction valve and expandable sampler chamber assembly 38 and further includes a rotation type circulating valve assembly 586 interposed between the upper end of the tester valve assembly 740 and the drill pipe 36. The remainder of the drill test string 10*e* is substantially identical to the drill test string 10 described in detail above.

Figure 18A:
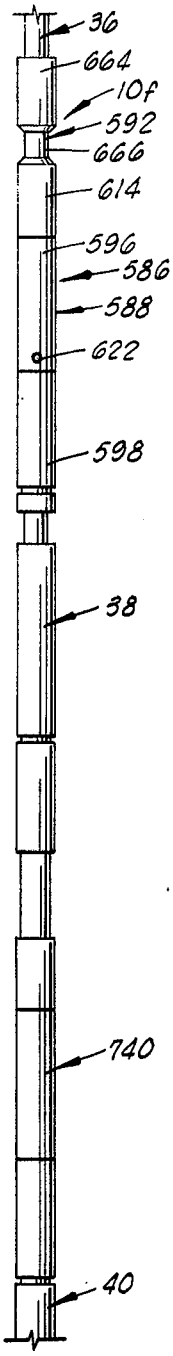
FIG. 18A is an elevational view illustrating an alternate embodiment of the drill test string of FIG. 18 having the longitudinally reciprocable tester valve assembly interposed therein immediately below the flow direction valve and expandable sampler chamber assembly.

FIG. 18A illustrates yet another form of the drill test string of the present invention similar to that illustrated in FIG. 18 and generally designated by the reference character 10*f*. The drill test string 10*f* includes a longitudinally reciprocable tester valve assembly 740 interposed therein immediately below the flow direction valve and expandable sampler chamber assembly 38 and above the upper end of the flow stream recorder assembly 40. The drill test string 10*f* further includes a rotation type circulating valve assembly 586 interposed between the upper end of the flow direction valve and expandable sample chamber assembly 38 and the drill pipe 36. The remainder of the drill test string 10*f* is substantially identical to the drill test string 10 described in detail above.

The operation of the drill test string 10*a* is substantially identical to the operation of the drill test string 10 described in detail above. The drill test string 10*a* permits the operator to run the drill test string 10*a* into the well bore with the rotation type circulating valve assembly 586 in an open position. After samples have been taken in the performance of the drill string test, it may be found that it is impossible to unseat the packer 46 to permit circulation around the packer through the perforations in the anchor pipe 50. By rotating the drill test string above the valve assembly 586, the valve assembly may be opened to provide communication between the interior of the drill test string and the annulus at a point below the flow direction valve and expandable sampler chamber assembly 38 to close the drill test string to fluid flow through the valve assembly 586 and permit circulation or reverse circulation therethrough to remove formation fluids from the drill test string.

In a similar manner, the drill test string 10*b* permits the actuation of the rotation type circulating valve assembly 586 above the flow direction valve and expandable sampler chamber assembly 38 to communicate the interior of the drill test string with the annulus to permit circulation or reverse circulation of well fluids from the drill test string and the well bore at a point immediately above the flow direction valve and expandable sampler chamber assembly 38 while closing the drill test string to fluid flow through the valve assembly 586.

It will also be understood that both the drill test strings 10*a* and 10*b* may be run in the well bore with the rotation type circulating valve assembly 586 set with the elements thereof in a condition closing the drill test string to fluid flow therethrough. After the packer assembly 46 has been set as described above for the drill test string 10, the valve assembly 586 may be moved from a position closing the drill test string to a position opening the drill test string through rotation of the drill test string thereabove to allow formation fluids to flow upwardly through the drill test string where samples may be trapped in the flow direction valve and expandable sampler chamber assembly 38 as described above. The valve assembly 586 may then be actuated to a closed position blocking fluid flow through the drill test string. At this time, a closed-in pressure test may be conducted on the formation under test. The valve assembly 586 may be again actuated to close the drill test string to fluid flow therethrough and communicate the interior of the drill test string to the annulus for circulation or reverse circulation through the annulus and the drill test string to remove formation fluids therefrom.

It may also be desirable to fill the drill test strings 10*a* or 10*b* above the closed valve assembly 586 with a displacement liquid having a density less than the density of the mud in the well bore before opening the valve assembly 586 to secure a sample of formation fluids in the sampler chamber assembly 38. Preferably water will be introduced intermittently as each stand of pipe is connected to the drill test string as it is being run in to protect the pipe from collapsing and cushion the pressure release when the tester valve is opened. As an alternative it may be desirable to partially fill the drill test strings 10*a* or 10*b* with mud, some of which may be displaced from the well bore as the drill test string is run in, before opening the valve assembly 586.

The operation of the drill test strings 10*c* and 10*d* is substantially identical to the operation of the drill test string 10 with the exception that the drill test strings 10*c* and 10*d* are run in the well bore with the longitudinally reciprocable tester valve assembly 740 in the closed position blocking fluid flow through the drill test string. The rotation type circulation valve assembly 586 is initially in the open position. After the packer assembly 46 is set, drill string weight may be set down on the tester valve assembly 740 to actuate it from the closed position to an open position opening the drill test string to fluid flow therethrough. Since the drill test string above the tester valve 740 is empty, formation fluids in the zone under test are free to flow upwardly through the drill test string through the flow direction valve and expandable sampler chamber assembly where samples of the formation fluid have been trapped in the manner described above for the drill test string 10. The tester valve may then be closed by raising the drill test string thereby preventing further flow of formation fluids upwardly through the drill test string 10*c*. If desired, the drill string may then be rotated to place the rotation type circulating valve assembly 586 in the circulating position communicating the interior of the drill test string with the annulus. The tester valve 740 may again be opened and circulation or reverse circulation may be conducted through the annulus and the drill test string to remove formation fluids from the drill test string and well bore above the circulating valve assembly 586.

Again it may be desirable when using the drill test strings 10*c* and 10*d* to fill the drill test string above the closed tester valve 740 with displacement liquid of a density less than the density of the mud before opening the tester valve 740 to secure samples of the formation fluids, or partially fill the drill test string with mud before opening the valve assembly 586.

The operation of the drill test strings 10*e* and 10*f* is substantially identical to the operation described for the drill test strings 10*c* and 10*d* with the exception that the rotation type circulating valve assembly 586 may be actuated from an open position to a closed circulation position through rotation of the drill test string while maintaining the tester valve assembly 740 in a closed position. This feature will allow circulation or reverse circulation of formation fluids from the drill test string or annulus from a point just above the closed tester valve 740 in drill string 10*e* or from a point just above the sampler chamber assembly 38 in the drill string 10*f* if it appears that such circulation is desirable.

As noted above, the drill test strings, 10*c*, 10*d*, 10*e* and 10*f* may be filled above the closed tester valve 740 with displacement fluid or liquid having a density less than the density of the column of mud exerting hydrostatic pressure on the zone under test or may be partially filled with a column of mud which exerts hydrostatic pressure on the closed tester valve 740 less than the hydrostatic pressure on the zone under test or the formation pressure. When the tester valve 740 is opened after the packer assembly 46 is set, the operation previously described for the drill test string 10 may be performed. It will be understood that after the formation fluid sample has been taken in the flow direction valve and expandable sampler chamber assembly 38, the tester valve 740 may be maintained in an open position and the valve 488 opened and the pump 490 actuated to add liquid if necessary and to increase the hydraulic pressure within the drill test string to force the remaining formation fluid in the drill test string from the lower end thereof back into the formation in the zone under test. At this time the tester valve 740 may be closed and the rotation type circulating valve assembly 586 actuated to the circulation position so that circulation or reverse circulation may be performed to remove any traces of formation fluid from the drill test string prior to the unseating of the packer assembly 46 and the removal of the drill test string from the well bore. In the drill strings 10*c* and 10*d* the tester valve 740 would require reopening in order to circulate or reverse circulate through the valve assembly 586.

It will be seen that this latter technique used with the drill test strings 10*c*, 10*d*, 10*e* and 10*f* eliminates the necessity of displacing the column of mud from the interior of the drill test string with a displacing liquid prior to the setting of the packer assembly 46 and the sampling of the formation fluid in the flow direction valve and expandable sampler chamber assembly 38. It will also be seen that the employment of both the rotation type circulating valve assembly 586 and the longitudinally reciprocable tester valve assembly 740 in the drill test strings 10*c*, 10*d*, 10*e* and 10*f* assures that the drill test string will remain closed during its withdrawal from the well bore. It will also be noted that reverse circulation through the circulation valve assembly 586 allows the complete removal of the displacing liquid from the drill test string prior to the withdrawal thereof from the well bore. The mud in the drill test string wall rain therefrom through the circulating ports in the circulating valve assembly 586 as the drill test string is withdrawn from the well bore thus providing a dry string on the rig floor to facilitate the disassembly of the drill test string upon its withdrawal from the well bore.

Referring again to FIG. 14, the J-slot could be modified to make position No. 2 a closed position similar to position No. 6, thus giving only one open position (No.4). This could be desirable in order to add an indexing step prior to actual opening of the sampler, in the event the operator felt such was more advantageous than the double opening feature of the J-slot of FIG. 14.

It will be seen from the foregoing detailed description of the present invention that the drill test strings employing the flow direction and expandable sampler assembly and the novel method of employment of the drill test strings provide convenient and safe means for the testing of the formulation in a zone wherein the anticipated formation pressure is approximately 20,000 psi and the temperatures anticipated are approximately 450° F. and where the well fluids are anticipated to contain quantities of hydrogen sulfide and/or carbon dioxide.

Changes may be made in the combination and arrangement of the parts or elements as heretofore set forth in the specification and shown in the drawings without departing from the spirit and scope of the invention as defined by the following claims.

What is claimed is:

1. A method of testing a formation in a zone intersected by a well bore, comprising the steps of:
   a. maintaining hydrostatic pressure on the formation with a column of first liquid in the well bore, said hydrostatic pressure exceeding the formation pressure at the zone;
   b. positioning a conduit, having closed valve means interposed therein closing the conduit to fluid flow therethrough, in the well bore with the lower end of the conduit opening proximate to the zone under test;
   c. introducing a quantity of a second liquid into the conduit;
   d. isolating the annulus above the zone under test from said zone;
   e. opening the valve means in the conduit;
   f. allowing fluid from the formation in the zone under test to enter the lower end of the conduit and flow a distance therethrough;
   g. trapping a sample of the formation fluid in the conduit; and
   h. closing the valve means in the conduit to close the conduit to the fluid flow therethrough.

2. The method as defined in claim 1 characterized further to include the additional step of:
   increasing the volume of the trapped sample to lower the pressure thereof.

3. The method as defined in claim 1 characterized further to include the additional steps of:
   placing the annulus and the zone under test in full fluid communication; and
   removing the conduit and trapped sample of formation fluid from the well bore.

4. The method as defined in claim 1 wherein the density of the second liquid is less than the density of the first liquid.

5. The method as defined in claim 1 wherein the hydrostatic pressure of the quantity of second liquid acting on the closed valve member is less than the formation pressure.

6. A method of testing a formation in a zone intersected by a well bore, comprising the steps of:
   a. maintaining hydrostatic pressure on the formation with a column of a first liquid in the well bore, said hydrostatic pressure exceeding the formation pressure at the zone;
   b. positioning a conduit, having closed valve means interposed therein, in the well bore with the lower end of the conduit opening proximate to the zone under test;
   c. introducing a quantity of a second liquid into the conduit;
   d. isolating the annulus above the zone under test from said zone;
   e. opening said valve means;
   f. allowing fluid from the formation in the zone under test to enter the lower end of the conduit and flow a distance therethrough;
   g. trapping a sample of formation fluid in the conduit;
   h. increasing the hydraulic pressure in the conduit to force the remaining formation fluid from the lower end of the conduit back into the formation in the zone under test;
   i. closing said valve means to close the conduit to fluid flow therethrough;
   j. communicating the interior of the conduit with the annulus at a point above said valve means; and
   k. circulating the fluid in the annulus and in the conduit above said closed valve means.

7. The method as defined in the claim 6 wherein the step of circulating the fluid in the annulus and the conduit is characterized further to include circulating the fluid in the annulus downwardly into the conduit and circulating the fluid in the conduit upwardly.

8. The method as defined in claim 6 wherein the step of circulating the fluid in the annulus and in the conduit is characterized further to include circulating the fluid in the conduit downwardly into the annulus and circulating the fluid in the annulus upwardly.

9. The method as defined in claim 6 characterized further to include the additional step of:
   increasing the volume of the trapped sample to lower the pressure thereof.

10. The method as defined in claim 6 characterized further to include the additional steps of:
   placing the annulus in the zone under test in full fluid communication; and
   removing the conduit and trapped sample of formation fluid from the well bore.

11. The method as defined in claim 6 wherein the density of the second liquid is less than the density of the first liquid.

12. The method as defined in claim 6 wherein the hydrostatic pressure of the quantity of second liquid acting on the closed valve means is less than the formation pressure.

13. A method of testing a formation in a zone intersected by a well bore, comprising the steps of:
   a. maintaining hydrostatic pressure on the formation with a column of liquid in the well bore, said hydrostatic pressure exceeding the formation pressure at the zone;
   b. positioning a conduit, having valve means interposed therein closing the conduit to fluid flow therethrough, in the well bore with the lower end of the conduit opening proximate to the zone under test;
   c. introducing a quantity of liquid into the conduit;
   d. isolating the annulus above the zone under test from said zone;
   e. opening said valve means in the conduit;
   f. allowing fluid from the formation in the zone under test to enter the lower end of the conduit and flow a distance therethrough;
   g. trapping a sample of formation fluid in the conduit;
   h. closing said valve means to close the conduit to fluid flow therethrough;
   i. communicating the interior of the conduit with the annulus above said valve means; and
   j. circulating the fluid in the annulus and in the conduit.

14. A method of testing a formation in a zone intersected by a well bore, comprising the steps of:
   a. maintaining hydrostatic pressure on the formation with a column of liquid in the well bore, said hydrostatic pressure exceeding the formation pressure at the zone;

b. positioning a closed conduit in the well bore with the lower end thereof opening proximate to the zone under test;

c. isolating the annulus above the zone under test from said zone;

d. opening the conduit to reduce the hydraulic pressure acting on the zone under test below the formation pressure of the zone under test;

e. allowing fluid from the formation in the zone under test to enter the lower end of the conduit and flow a distance therethrough;

f. trapping a sample of formation fluid in the conduit;

g. increasing the hydraulic pressure in the conduit to force the remaining formation fluid from the lower end of the conduit back into the formation in the zone under test;

h. closing the conduit to fluid flow therethrough;

i. communicating the interior of the conduit with the annulus between the conduit and the well bore at a point above the closure to fluid flow through the conduit; and j. circulating the fluid in the conduit and the annulus.

15. An apparatus for testing a formation in a zone penetrated by a well bore, comprising:

conduit means positionable in the well bore for conveying liquids therethrough within the well bore;

sampler chamber means carried by said conduit means and in selective communication with the interior thereof;

valve means carried by said conduit means and responsive to manipulation of said conduit means for selectively opening said conduit means to fluid flow bypassing said sampler chamber means and, alternately, directing fluid flow from the interior of said conduit means through said sampler chamber means and back into the interior of said conduit means, and again opening said conduit means to fluid flow bypassing said sampler chamber means while simultaneously trapping a fluid sample in said sampler chamber means;

well bore isolation means supported by said conduit means and responsive to manipulation of said conduit means for selectively isolating the zone under test from the annulus between the exterior of said conduit means and the wall of the well bore;

port means carried by said conduit means below said well bore isolation means for providing fluid communication between the isolated zone under test and the interior of the conduit means; and valve means carried in said conduit means adjacent said sampler chamber means for selectively opening and closing said conduit means to fluid flow therethrough.

16. The apparatus as defined in claim 15 wherein said valve means carried in said conduit means adjacent said sampler chamber means is moved between opening and closing positions by vertical reciprocation of said conduit means.

17. The apparatus as defined in claim 15 wherein said valve means carried in said conduit means adjacent said sampler chamber means is positioned in said conduit means below said sampler chamber means.

18. The apparatus as defined in claim 17 wherein said valve means carried in said conduit means below said sampler chamber means is moved between opening and closing positions by vertical reciprocation of said conduit means.

19. The apparatus as defined in claim 18 characterized further to include bypass means for communicating the interior and exterior of said conduit means below said valve means and, alternately, blocking communication between the interior and exterior of said conduit means.

20. The apparatus as defined in claim 17 wherein said valve means carried in said conduit means below said sampler chamber means is actuated between positions opening and closing said conduit means by rotation of said conduit means.

21. The apparatus as defined in claim 20 wherin said valve means carried in said conduit means below said sampler chamber means is characterized further to include circulating valve means for communicating the interior of said conduit means to the exterior thereof in response to rotation of said conduit.

22. The apparatus as defined in claim 15 wherein said valve means carried in said conduit means adjacent said sampler chamber means is positioned in said conduit means above said sampler chamber means.

23. The apparatus of claim 22 wherein said valve means carried in said conduit means above said sampler chamber means for selectively opening and closing said conduit means to fluid flow therethrough is actuated by vertical reciprocation of said conduit means.

24. The apparatus as defined in claim 22 wherein said valve means carried in said conduit means above said sampler chamber means for selectively opening and closing said conduit means to fluid flow therethrough is actuated by rotation of said conduit means.

25. The apparatus as defined in claim 22 wherein said valve means carried in said conduit means above said sampler means for selectively opening and closing said conduit means to fluid flow therethrough is actuated by vertical reciprocation of said conduit means; and wherein said apparatus is characterized further to include circulating valve means carried in said conduit means above said sampler chamber means for communicating the interior of said conduit means with the annulus between the exterior of said conduit means and the wall of the well bore in response to rotation of said conduit means.

26. The apparatus as defined in claim 22 wherein said valve means carried in said conduit means above said sampler means for selectively opening and closing said conduit means to fluid flow therethrough is actuated by vertical reciprocation of said conduit means; and wherein said apparatus is characterized further to include circulating valve means carried in said conduit means below said sampler chamber means for communicating the interior of said conduit means with the annulus between the exterior of said conduit means and the wall of the well bore in response to rotation of said conduit means.

* * * * *